US008419153B2

(12) United States Patent
Kaneko et al.

(10) Patent No.: US 8,419,153 B2
(45) Date of Patent: Apr. 16, 2013

(54) INK JET RECORDING APPARATUS AND INK JET RECORDING METHOD

(75) Inventors: Takumi Kaneko, Tokyo (JP); Yasunori Fujimoto, Inagi (JP); Tomokazu Yanai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 114 days.

(21) Appl. No.: 12/839,086

(22) Filed: Jul. 19, 2010

(65) Prior Publication Data

US 2010/0277521 A1 Nov. 4, 2010

Related U.S. Application Data

(63) Continuation of application No. PCT/JP2009/051388, filed on Jan. 22, 2009.

(30) Foreign Application Priority Data

Jan. 22, 2008 (JP) ..... 2008-011834

(51) Int. Cl.
*B41J 2/05* (2006.01)

(52) U.S. Cl.
USPC ..... 347/15; 347/5; 347/14

(58) Field of Classification Search ..... 347/41, 347/42, 43, 14–15, 5, 6, 9
See application file for complete search history.

(56) References Cited

U.S. PATENT DOCUMENTS 6,435,655 B1 8/2002 Yoshihira et al.
6,511,143 B1 1/2003 Ishikawa et al.
6,517,192 B2 2/2003 Kaneko et al.
6,779,873 B2 8/2004 Maeda et al.
6,834,927 B2 12/2004 Yashima et al.
7,121,641 B2 * 10/2006 Nitta et al. ..... 347/15
7,198,345 B2 4/2007 Shibata et al.

(Continued)

FOREIGN PATENT DOCUMENTS

JP 2000-103088 A 4/2000
JP 2002-248798 A 9/2002

(Continued)

OTHER PUBLICATIONS

International Search Report—PCT/JP2009/051388, Japanese Patent Office, Feb. 24, 2009.

*Primary Examiner* — Lam S Nguyen
(74) *Attorney, Agent, or Firm* — Fitzpatrick, Cella, Harper & Scinto

(57) ABSTRACT

When recording with the use of a multi-pass recording method, the order in which a specific ink and the other inks are applied in layers is controlled while preventing the multiple recording scans (passes) from becoming unnecessary uneven in terms of the ink recording permission ratio, and also, the ratio with which the specific ink is permitted to be applied to each unit pixel is determined for each recording scan (pass), based on the information (for example, CMYK information, RGB information, etc.) regarding the specific ink and the other inks, which are to be applied to each unit pixel. Therefore, it is possible to change the recording scan(s), to which the application of the specific ink is concentrated, based on the application conditions for the specific ink and the other inks, and therefore, it is possible to change the ratio with which the specific ink is applied before or after the other inks are applied. Therefore, it is possible to control the order in which the specific ink and the other inks are applied in layers.

14 Claims, 26 Drawing Sheets

U.S. PATENT DOCUMENTS

| | | | | |
|---|---|---|---|---|
| 7,290,854 | B2 * | 11/2007 | Mizutani et al. | 347/41 |
| 2008/0186348 | A1 | 8/2008 | Yanai et al. | |
| 2008/0316554 | A1 | 12/2008 | Yanai et al. | |
| 2009/0168087 | A1 | 7/2009 | Fujimoto et al. | |
| 2010/0165390 | A1 | 7/2010 | Nakamura et al. | |
| 2010/0171972 | A1 | 7/2010 | Fujita et al. | |
| 2010/0188678 | A1 | 7/2010 | Miyazaki et al. | |

FOREIGN PATENT DOCUMENTS

| | | | |
|---|---|---|---|
| JP | 2002-292910 | A | 10/2002 |
| JP | 2004-209943 | A | 7/2004 |
| JP | 2005-081754 | A | 3/2005 |

* cited by examiner

141C AR. A AR. B

| | | | |
|---|---|---|---|
| 0010 | 0010 | 0001 | 0001 |
| 0010 | 0010 | 0001 | 0001 |

141M AR. A AR. B

| | | | |
|---|---|---|---|
| 0010 | 0001 | 0001 | 0001 |
| 0001 | 0010 | 0001 | 0001 |

141Y AR. A AR. B

| | | | |
|---|---|---|---|
| 0010 | 0010 | 1000 | 1000 |
| 0010 | 0010 | 1000 | 1000 |

141K AR. A AR. B

| | | | |
|---|---|---|---|
| 0001 | 0001 | 0010 | 0001 |
| 0001 | 0001 | 0001 | 0010 |

142C AR. A AR. B

142M AR. A AR. B

142Y AR. A AR. B

142K AR. A AR. B

143MP AR. A AR. B

| | | | |
|---|---|---|---|
| 1 | 1 | 0 | 0 |
| 0 | 1 | 0 | 0 |

144A MSK PTRN A

144B MSK PTRN B

145C AR. A AR. B

145M AR. A AR. B

145Y AR. A AR. B

145K AR. A AR. B (a)

| | | | |
|---|---|---|---|
| 255 | 250 | 168 | 150 |
| 250 | 192 | 170 | 120 |
| 160 | 150 | 105 | 80 |
| 48 | 35 | 16 | 0 |

(c)

| |
|---|
| 12.5% |
| 12.5% |
| 12.5% |
| 12.5% |
| ⋮ |

(d)

| |
|---|
| 25% |
| 25% |
| 25% |
| 25% |
| ⋮ |

(b)

| | | | |
|---|---|---|---|
| 0 | 1 | 0 | 1 |
| 0 | 1 | 1 | 1 |
| 0 | 1 | 0 | 1 |
| 1 | 1 | 1 | 1 |

(e)

| | | | |
|---|---|---|---|
| 12.5% | 25% | 12.5% | 25% |
| 12.5% | 25% | 25% | 25% |
| 12.5% | 25% | 12.5% | 25% |
| 25% | 25% | 25% | 25% |

(f)

| | | | |
|---|---|---|---|
| 32 | 63 | 21 | 38 |
| 31 | 48 | 43 | 30 |
| 20 | 38 | 13 | 20 |
| 12 | 9 | 4 | 0 |

(g)

| GRADATION DATA | DOT NUMBER | DOT ARNGMNT |
|---|---|---|
| 0000 | 0 | |
| 0001 | 1 | |
| 0010 | 2 | |
| 0011 | 3 | |
| 0100 | 4 | |
| 0101 | 5 | |
| 0110 | 6 | |
| 0111 | 7 | |
| 1000 | 8 | |

Fig. 19

| | M. PTRN 0 | M. PTRN 1 | M. PTRN 16 | M. PTRN 30 | M. PTRN 31 |
|---|---|---|---|---|---|
| AREA8 | 12.5% | 12.9% | 19% | 24.6% | 25% |
| | 12.5% | 12.9% | 19% | 24.6% | 25% |
| | ⋮ | ⋮ | ⋮ | ⋮ | ⋮ |
| AREA7 | 12.5% | 12.8% | 16.4% | 19.8% | 20% |
| | 12.5% | 12.8% | 16.4% | 19.8% | 20% |
| | ⋮ | ⋮ | ⋮ | ⋮ | ⋮ |
| AREA6 | 12.5% | 12.6% | 13.8% | 14.9% | 15% |
| | 12.5% | 12.6% | 13.8% | 14.9% | 15% |
| | ⋮ | ⋮ | ⋮ | ⋮ | ⋮ |
| AREA5 | 12.5% | 12.5% | 11.2% | 10.1% | 10% |
| | 12.5% | 12.5% | 11.2% | 10.1% | 10% |
| | ⋮ | ⋮ | ⋮ | ⋮ | ⋮ |
| AREA4 | 12.5% | 12.3% | 9.9% | 7.7% | 7.5% |
| | 12.5% | 12.3% | 9.9% | 7.7% | 7.5% |
| | ⋮ | ⋮ | ⋮ | ⋮ | ⋮ |
| AREA3 | 12.5% | 12.3% | 9.9% | 7.7% | 7.5% |
| | 12.5% | 12.3% | 9.9% | 7.7% | 7.5% |
| | ⋮ | ⋮ | ⋮ | ⋮ | ⋮ |
| AREA2 | 12.5% | 12.3% | 9.9% | 7.7% | 7.5% |
| | 12.5% | 12.3% | 9.9% | 7.7% | 7.5% |
| | ⋮ | ⋮ | ⋮ | ⋮ | ⋮ |
| AREA 1 | 12.5% | 12.3% | 9.9% | 7.7% | 7.5% |
| | 12.5% | 12.3% | 9.9% | 7.7% | 7.5% |
| | MP' = 0 | MP' = 1 | MP' = 16 | MP' = 30 | MP' = 31 |

Fig. 20

| | | | |
|---|---|---|---|
| 255 | 250 | 168 | 150 |
| 250 | 192 | 170 | 120 |
| 160 | 150 | 105 | 80 |
| 48 | 35 | 16 | 0 |

(c)

| MSK PTRN 0 | MSK PTRN 1 | MSK PTRN 16 | MSK PTRN 30 | MSK PTRN 31 |
|---|---|---|---|---|
| 12.5 % | 12.3 % | 9.9% | 7.7% | 7.5% |
| 12.5 % | 12.3 % | 9.9% | 7.7% | 7.5% |
| 12.5 % | 12.3 % | 9.9% | 7.7% | 7.5% |
| 12.5 % | 12.3 % | 9.9% | 7.7% | 7.5% |
| ⋮ | ⋮ | ⋮ | ⋮ | ⋮ |

(b)

| | | | |
|---|---|---|---|
| 0 | 1 | 15 | 18 |
| 0 | 3 | 10 | 20 |
| 5 | 5 | 21 | 25 |
| 28 | 31 | 31 | 31 |

(d)

| | | | |
|---|---|---|---|
| 12.5 % | 12.3 % | 10.1 % | 9.6% |
| 12.5 % | 12.0 % | 10.9 % | 9.3% |
| 11.7 % | 11.7 % | 9.1% | 8.5% |
| 8.0% | 7.5% | 7.5% | 7.5% |

(e)

| | | | |
|---|---|---|---|
| 32 | 31 | 17 | 14 |
| 31 | 23 | 19 | 11 |
| 19 | 18 | 10 | 7 |
| 4 | 2 | 1 | 0 |

(f)

(g)

| | | | |
|---|---|---|---|
| | 16 | 32 | 16 |
| | 32 | 64 | 32 |
| | 16 | 32 | 16 |
| | | | |

(h)

| | | | |
|---|---|---|---|
| 32 | 15 | -15 | -2 |
| 31 | -9 | -45 | -21 |
| 23 | -2 | -22 | -9 |
| 11 | 9 | 4 | 0 |

(i)

| | | | |
|---|---|---|---|
| 64 | 46 | 2 | 12 |
| 62 | 14 | -26 | -10 |
| 42 | 16 | -12 | -2 |
| 15 | 11 | 5 | 0 |

INK JET RECORDING APPARATUS AND INK JET RECORDING METHOD

This application is a continuation of PCT/JP2009/051388, filed Jan. 22, 2009.

FIELD OF THE INVENTION AND RELATED ART

The present invention relates to an ink jet recording apparatus which records an image on recording medium while moving its ink applying means (recording head), which is capable of applying multiple kinds of ink, in a manner to scan the recording medium. It also relates to an ink jet recording method.

An ink jet recording apparatus is superior to a recording apparatus of the other type in that it is capable of recording at a higher density and a higher speed, is lower in cost, and is quieter than the recording apparatus of the other type. It has been commercialized in various forms, for example, an outputting device for various apparatuses, a portable printer, etc. In recent years, there have come to be offered various ink jet recording apparatuses capable of forming a color image with the use of multiple inks different in color.

Generally, an ink jet recording apparatus has: a recording means (recording head) which jets ink in response to recording signals; a carriage on which the recording head and an ink container (or ink containers) are mounted; a conveying means which conveys recording medium; and a controlling means which controls the preceding means. In the case of an ink jet recording apparatus of the serial scan type, an image is formed in steps by the alternate repetitions of the carriage movement and the recording medium movement. Hereafter, the direction of the carriage movement will be referred to as the primary recording scan direction, and the direction of recording medium, which is intersectional to the primary recording scan direction, will be referred to as the secondary scan direction. The carriage of a full-color ink jet recording apparatus carries four or more ink containers, which are different in the color of the ink they contains. Thus, it can output a full-color image by applying, to recording medium, each of the multiple inks independently from the other inks, and/or applying in combination two or more among the multiple inks to generate colors different from the color of any of the multiple inks, on the recording medium.

By the way, in the field of ink jet recording method, it has been known that the order in which inks are applied to recording medium has various effects upon how an intended image will come out on the recording medium. For example, a phenomenon is disclosed in Japanese Laid-open Patent Application 2002-248798 that the chromaticity of an image, that is, tone of an image, is affected by the order in which inks are applied to recording medium. According to this document, in a case where multiple inks, different in color, are applied to a given spot on a sheet of recording medium specifically made for ink jet recording, the earlier in the order in which an ink among multiples inks is applied to the recording medium, the stronger the effects of the ink upon the resulting color of the spot.

Further, in Japanese Laid-open Patent Application 2005-81754, a technology for improving an image in friction resistance is disclosed. According to this technology, an image formed with color inks is improved in friction resistance by applying a liquid coat upon the image after the formation of the image. Here, "friction resistance" means the resistance of an image to the friction which occurs between an image (recording medium) and a nail, cloth, etc., as the image (recording medium) is rubbed by the nail, cloth, etc. The protecting coat of the liquid type is designed to be applied to recording medium after the formation of an image on recording medium. Thus, applying the protective coat of liquid type to recording medium before the formation of an image on the recording medium makes the protective coat of the liquid type reduces the protective coat in effectiveness.

As described above, intentionally changing the order in which inks are applied to recording medium by an ink jet recording apparatus can significantly improve the ink jet recording apparatus in terms of the quality of an image it forms. One of the factors which are essential for the control of the order in which inks are applied to recording medium is the structure of an ink jet head, more specifically, the order in which the multiple columns of nozzles, which are different in the color, or type, of the ink they jet, are arranged.

Generally speaking, in terms of the recording head structure, the color ink jet recording apparatuses of the serial type can be separated into two groups, that is, a vertical arrangement group and a horizontal arrangement group. In the case of the vertical arrangement group, the multiple columns of nozzles of a recording head are aligned in a single line which is parallel to the secondary scan direction, whereas in the case of the horizontal arrangement group, the columns of nozzles of a recording head are arranged in tandem in the direction perpendicular to the secondary scan direction, although each nozzles columns is parallel to the secondary scan direction. Next, the structure of the recording head in each group will be described one by one.

FIG. 1 is a schematic drawing for describing a recording head, the nozzle columns of which are arranged in a single line which is perpendicular to the primary scanning direction (vertical nozzle column arrangement type). This recording head 151 has a nozzle column 15Y for yellow ink, a nozzle column 15M for magenta ink, a nozzle column 15C for cyan ink, and a nozzle column 15K for black ink, which are aligned in a single line in the direction parallel to the secondary scan direction so that they do not overlap with each other in terms of the primary scan direction. In the case of an ink jet head structured so that the nozzle columns are in a single line which is perpendicular to the primary scan direction as described above, each time the recording head is moved in the primary scan direction to record an image on recording medium, each ink is applied to a different area of the recording medium from the areas of the recording medium, to which the other inks are applied. Thus, whether the recording head 151 is moved in the outward direction (rightward in FIG. 1), or the backward direction (leftward in FIG. 1), to form an image on recording medium, the order in which the various inks are applied to the recording medium is always an order of black→cyan→magenta→yellow. For example, in the case of a blue image, which is formed by a mixture of cyan and magenta inks, it is always in the order of cyan→magenta that the two inks are applied to recording medium. As long as a recording head is structured as described above, even in a case where a protective liquid coat, such as the one described above, is used to form an image, the inks and protective liquid coat can be applied in the intended order by positioning the nozzle columns for jetting the protective coat liquid, on the most downstream side in terms of the secondary scan direction.

In the case of a recording head structured so that its nozzle columns are aligned in a single line which is parallel to the secondary scan direction, the order in which inks are applied to recording medium can be fixed, but, it is difficult to change the order in response to the circumstantial changes. Further, the multiple nozzle columns, different in ink color or type, are aligned in a single line which is parallel to the secondary scan direction. Therefore, it is likely to be longer in terms of the secondary scan direction than recording heads of the other type. The lengthening of a recording head requires increase in the overall size of an image forming apparatus, and also, requires an image forming apparatus to be provided with a complicated mechanism for keeping recording medium flatly held. In other words, the lengthening of a recording head increases in cost the main assembly of an image forming apparatus, as well as the cost of the recording head itself.

FIG. 2 is a schematic drawing for describing a recording head structured so that its multiple nozzle columns are arranged side by side in parallel (horizontal nozzle column arrangement type). This recording head 171 has a nozzle column 17Y for yellow ink, a nozzle column 17M for magenta ink, a nozzle column 17C for cyan ink, and a nozzle column 17K for black ink, which are arranged in tandem in the direction parallel to the primary scan direction (side by side and in the direction perpendicular to the primary scan direction). In the case of a recording head structured so that its nozzles columns are arranged side by side as described above, the increase in the number of nozzle columns is unlikely to require the recording head to be increased in length as is a recording head of the vertical type. Therefore, the employment of this type of recording head makes it possible to realize a recording apparatus which is relatively small and inexpensive.

In the case of a recording head, the nozzle columns of which are aligned in a single line perpendicular to the recording medium conveyance direction (horizontal nozzle column arrangement type), each time the recording head is moved in the primary scan direction to recording an image on recording medium, multiple inks which are different in color are applied to the same area of the recording medium. Thus, when the recording head is moved in the outward direction, the inks are applied in the order of yellow→magenta→cyan→black, whereas when the recording head is moved in the return direction, the inks are applied in the opposite order. As described above, the tone of an image to be formed by an ink jet recording apparatus is affected by the order in which inks are applied to recording medium. Thus, the reversal in the ink application order, which occurs each time recording medium is conveyed, is one of the causes of the formation of an image inferior in quality. For example, if a blue image, the color of which is generated by the mixture of cyan and magenta inks, is formed with the use of an ink jet head of this type, the resultant blue image will be made up of multiple alternately positioned horizontal blue strips of two kinds (different in tone), that is, a blue strips generated as cyan and magenta were applied in an order of cyan→magenta, and a blue strips generated as cyan and magenta inks were applied in an order of magenta→cyan. The presence of these alternately positioned blue strips different in toner makes the blue image appear nonuniform in color.

Thus, in order to deal with the above-described problem, an ink jet recording apparatus is generally designed to employ the so-called multi-pass recording method. The multi-pass recording method completes an image in steps by moving a recording head multiple times in the primary scan direction across each portion of recording medium, while thinning the image data recordable per primary scan, with the use of mask patterns prepared in advance.

FIG. 3 is a schematic drawing for simply describing the multi-pass recording method. That is, FIG. 3 shows how an image is recorded on a sheet of recording medium 52 with the use of a recording head 51 and the multi-pass (four pass) recording method. In this case, the recording medium 52 is conveyed in the secondary scan direction by a distance d, which is equivalent to ¼ the recording width of the recording head, during the interval between a recording head movement in the primary scan direction and the following recording head movement in the primary scan direction. In other words, in the case of this recording method, a given portion of an image is completed by four primary recording scans, which correspond to the four areas 1-4 of the recording head. Thus, the multiple dots, which align on the recording medium in the primary scan direction, are recorded by four different nozzles. Thus, an image formed with the use of the multi-pass recording method is significantly less in the nonuniformity attributable to the nonuniformity among the nozzles, being therefore significantly smoother in overall appearance, than an image formed by an ink jet recording apparatus of the abovementioned vertical nozzle column arrangement type. Further, even in the case where an image is formed by the two-way recording, the entire area of an image is given by the outward recording scan and the return recording scan. Therefore, it does not occur that the portion of an image, which is formed by a given primary recording scan, is different from the next portion of an image, in the order in which inks are applied. Therefore, an image formed with the use of the multi-pass recording method is less nonuniform in overall appearance in terms of color than an image formed with the use of an ink jet recording apparatus of the above described vertical nozzle column arrangement type.

FIG. 4 shows examples of mask pattern, which are used when an image is recorded with the use of a multi-pass (four pass) recording method, such as the one described with reference to FIG. 3. For simplicity, FIG. 4 shows a nozzle column 56 for a given color, and four mask patterns 57*a*-57*d*. The nozzle column is divided into four regions. Four regions record dots in accordance with the mask patterns 57*a*-57*d*, one for one. Each of the mask patterns 57*a*-57*d* is made up of multiple cells which allow a dot to be recorded, and multiple cells, which do not allow a dot to be recorded. In FIG. 4, black cells represent the cells which allow the recording head to form a dot, and white cells represent the cells which do not allow the recording head to form a dot. The four mask patterns 57*a*-57*d*, which are different in pattern, are complimentary among themselves. Where on recording medium each dot is to be actually recorded during each primary recording scan is determined by the logical product between these mask patterns and image data. For simplicity, FIG. 4 shows a mask pattern having 12 cells arranged in the pattern of 4 pixels×3 pixels. However, actual masks are substantially greater in the number of cells than the mask shown in FIG. 4, in terms of both the primary and secondary scan directions.

The employment of a multi-pass recording method, such as the one described above, makes it possible to make the cells of each mask pattern different in recording permission ratio, for each color, even when a recording head, the nozzle columns of which are arranged in tandem and in parallel, is used (specification of U.S. Pat. No. 6,779,873). Further, it makes it possible to control to some degrees the order in which inks are applied to recording medium, as it is possible when an ink jet recording apparatus, the nozzle columns of which are aligned in a single line, is used.

FIG. 5 shows an example of a set of mask patterns devised so that a specific ink (yellow ink) among four color inks, for example, is applied to recording medium as late as possible compared to the other inks (cyan ink, magenta ink, and black ink). Designated by a referential number 61 is the nozzle column for one among cyan, magenta, or black ink. The nozzle column 61 records an image while remaining under the control of mask patterns 63*a*-63*d*, whereas a nozzle column 62, which is for yellow ink, records an image while remaining under the control of mask patterns 64*a*-64*d*. With the use of mask patterns, such as those described above, which are prepared in advance, the cyan, magenta, and black inks are applied by 25% during each of the four passes, whereas the yellow ink is applied by 100% during the fourth recording pass. Thus, the yellow ink is higher than the cyan, magenta, and black inks, in the probability with which a given ink is applied to recording medium after the other inks are applied to the recording medium.

Disclosed in Japanese Laid-open Patent Application 2004-209943 is a technology for changing the nozzle usage ratio of a recording head according to the recording duty of image data. The method disclosed in this patent application also can control the order in which inks are applied in layers, according to recording duty.

As described above, by preparing multi-pass recording masks in advance according to various usages, it is possible to properly control the order in which inks are applied to recording medium, even in a case where the ink jet recording apparatus used for a recording operation employs a recording head structured so that its nozzles columns are arranged in tandem and in parallel.

DISCLOSURE OF INVENTION

However, in a case where mask patterns, such as those shown in FIG. 5, are employed, the specific ink (yellow ink) is allowed to be applied only by the nozzles in the region 4, which are used only during the last recording pass among the multiple (four) recording passes in the primary scan direction. That is, even if the portion of an image to be formed, is such a portion of the image that the special ink does not overlap with the other inks (nonspecific inks), the nozzles in the regions 1-3 are not used. Therefore, the nozzles become unnecessarily uneven in usage frequency, and also, the multiple recording passes become unnecessarily uneven in recording permission ratio. The unevenness in the nozzle usage frequency and the unevenness in recording permission ratio among the multiple recording passes detract the benefits of the multi-pass recording method, and also, lead to the shortening of the life of the recording head.

As described above, in the case of any of the conventional structures for an ink jet recording head, the multiple passes are fixed in the recording permission ratio for each ink, and therefore, the above described unevenness was unnecessary large.

The present invention is made in consideration of the above-described problems. Thus, its primary object is to control the order in which a specific ink and the other inks are applied in layers, while preventing the unevenness, in terms of the recording permission ratio for a specific ink, among the multiple recording passes from becoming unnecessarily large.

In order to accomplish the object, the present invention provides an ink jet recording apparatus capable of effecting recording onto a unit pixel of a recording material by a plurality of scannings of ink applying means for applying inks including a specific ink, said ink jet recording apparatus comprising determining means for determining a recording permission ratio of the specific ink onto the unit pixel in response to information relating to the specific ink and at least one of the inks other than the specific ink to be applied to the unit pixel.

In addition, there is provided an ink jet recording apparatus capable of effecting recording onto a unit pixel of a recording material by a plurality of scannings of ink applying means for applying inks including a specific ink, said ink jet recording apparatus comprising processing means capable of executing process for making higher a recording permission ratio of the specific ink to be applied to the unit pixel in at least one of a latter part scanning and a final scanning of the plurality of scannings than a recording permission ratio of the ink other than the specific ink, on the basis of information relating to the specific ink to be applied to the unit pixel and the ink other than the specific ink.

In addition, there is provided an ink jet recording apparatus capable of effecting recording onto a unit pixel of a recording material by a plurality of scannings of ink applying means for applying inks including a specific ink, said ink jet recording apparatus comprising processing means capable of executing process for making higher a recording permission ratio of the specific ink to be applied to the unit pixel in at least one of an early part scanning and an initial scanning of the plurality of scannings than a recording permission ratio of the ink other than the specific ink, on the basis of information relating to the specific ink to be applied to the unit pixel and the ink other than the specific ink.

In addition, there is provided an ink jet recording apparatus capable of effecting recording onto a unit pixel of a recording material by a plurality of scannings of ink applying means for applying inks including a specific ink, said ink jet recording apparatus comprising determining means for determining a recording permission ratio of the specific ink onto the unit area on the basis of RGB information corresponding to the unit pixel, for each scanning.

In addition, there is provided an ink jet recording method for effecting recording onto a unit pixel of a recording material by a plurality of scannings of ink applying means for applying inks including a specific ink, said ink jet recording method comprising determining step of determining a recording permission ratio of the specific ink onto the unit pixel in response to information relating to the specific ink to be applied to the unit pixel and at least one of the inks other than the specific ink; and a control step of controlling application of the specific ink onto the unit pixel on the basis of the recording permission ratio determined in said determining step.

In addition, there is provided an ink jet recording method for effecting recording onto a unit pixel of a recording material by a plurality of scannings of ink applying means for applying inks including a specific ink, said ink jet recording method comprising discriminating step of discriminating as to whether to execute process for making higher a recording permission ratio of the specific ink to be applied to the unit pixel in at least one of a latter part scanning and a final scanning of the plurality of scannings than a recording permission ratio of the ink other than the specific ink, on the basis of information relating to the specific ink to be applied to the unit pixel and the ink other than the specific ink; and a control step of controlling application of the specific ink onto the unit pixel on the basis of the result of discrimination of said discrimination step.

In addition, there is provided an ink jet recording method for effecting recording onto a unit pixel of a recording material by a plurality of scannings of ink applying means for applying inks including a specific ink, said ink jet recording method comprising discriminating step of discriminating as to whether to execute process for making higher a recording permission ratio of the specific ink to be applied to the unit pixel in at least one of an early part scanning and an initial scanning of the plurality of scannings than a recording permission ratio of the ink other than the specific ink, on the basis of information relating to the specific ink to be applied to the unit pixel and the ink other than the specific ink; and a control step of controlling application of the specific ink onto the unit pixel on the basis of the result of discrimination of said discrimination step.

In addition, there is provided an ink jet recording apparatus capable of effecting recording onto a unit pixel of a recording material by a plurality of scannings of ink applying means for applying inks including a specific ink, said ink jet recording apparatus comprising processing means capable of executing a process for changing a ratio of the specific ink applied onto the unit pixel in a scanning later than application of the ink other than the specific ink onto the unit pixel, in accordance with information relating to the specific ink and the ink other than the specific ink to be applied to the unit pixel to be applied to the unit pixel.

Hereafter, the preferred embodiments of the present invention will be described in detail. First, the characteristics of the preferred embodiments will be simply described. One of the characteristics of the embodiments of the present invention, which will be described later, is that when setting the ratio with a specific ink is permitted to be applied during each of the multiple recording passes for a unit pixel, not only the information regarding the specific ink, but also, the information regarding at least one of the inks other than the specific ink, are taken into consideration. That is, the ratio with which the specific ink is applied per unit pixel is set based on the information regarding the specific ink and nonspecific inks to be applied to the unit pixel (for example, CMYK information, RGB information, etc.). Thus, the primary recording scan, during which the specific ink is applied in concentration is changeable (modifiable), based on the conditions under which the specific ink and nonspecific inks are applied. Therefore, it is possible to change the ratio with the specific ink is applied before the recording pass(es) during which the other inks are applied, and the ratio with which the specific ink is applied after the recording pass(es) during which the other inks area applied. Therefore, it becomes possible to control the order in which the specific ink and the other ink(s) are applied in layers. In the preferred embodiments of the present invention, which will be described next, image processing steps for changing the ratio with which the specific ink is applied to each unit pixel during a relatively later primary recording pass than the primary recording passes during which the nonspecific inks are applied to the unit pixel, are carried out.

It is preferable that the decision regarding the recording permission ratio is made in accordance with the selection made regarding the "recording permission ratio setting pattern". "Recording permission ratio setting pattern" means the pattern for selecting recording permission ratio for a specific ink, for each of unit pixels. Hereafter, for convenience sake, this recording permission ratio setting pattern will be referred to as "mask pattern". As the recording permission ratio setting pattern, there are a set of binary mask patterns used in the first preferred embodiment, a set of multi-value mask patterns (for example, mask patterns in FIGS. 16 and 20) which is used in the second to fifth embodiments, etc.

In the preferred embodiments which will be described later, one mask pattern is selected among the multiple mask patterns, which are different in the recording permission ratio for at least the latter half of the multiple recording scan, or the last recording scan. To describe in more detail, a parameter (mask selection parameter MP, MP', etc.) for selecting one mask pattern among these multiple mask patterns is obtained based on the above described information regarding specific and nonspecific inks. Then, one of the patterns is selected based on the selection parameter obtained as described above. It is by the mask pattern selection, such as the above-described one, that the ratio with which a specific ink is permitted to be recorded during each primary recording scan. Incidentally, in the fifth embodiment, the RGB information regarding each unit pixel is used as the indirect information regarding the specific and nonspecific inks applied to the unit pixel. In the fifth embodiment, therefore, the abovementioned recording permission ratio for the specific ink is set based on the RGB information regarding each of the unit pixels.

It is preferable that the selected parameter, described above, is related to the relationship between the amounts A and B (densities) by which a specific ink and nonspecific ink(s) are applied to each unit pixel, in particular, the ratio (A/B) of the amount A by which the specific ink is applied, and the amount B by which the nonspecific ink(s) is applied. For example, it is desired that there is such a relationship between the selected parameter, described above, and the above described ratio, that the smaller the above described ratio, which is set based on the abovementioned information regarding the specific and nonspecific ink(s), the higher the selected pattern in the recording permission ratio of the specific ink, at least during the latter half of the multiple primary scans, or during the last recording scan of the multiple primary scans. With the presence of this relationship, it is possible to set the recording permission ratio for the specific ink so that the smaller the abovementioned ratio (the more dominant the nonspecific ink(s)), the higher the recording permission ratio for the specific ink during the latter half of the multiple recoding scans or the last of the multiple recording scan.

Further, another characteristic of the preferred embodiments which will be described next is that whether or not the process for making the recording permission ratio for the specific ink higher than the recording permission ratio for the nonspecific inks during at least the latter half, or the last, of the multiple recording scans, is to be carried out, is determined based on the information, such as the above described one, regarding the information regarding the specific and nonspecific inks to be applied to each of the unit pixels. With the employment of this characteristic feature, it is possible to increase the ratio with which the specific ink is applied during the later primary recording scan(s) than the primary recording scan(s) for the nonspecific ink(s).

Incidentally, there are cases in which it is more effective to apply a specific ink so that the specific ink is applied more during the front half of the multiple primary recording scans, or the last of the multiple primary recording scans, that is, the opposite of the above described arrangement. In such cases, it is necessary to carry out a process for increasing, as necessary, the ratio with which the specific ink is permitted to be applied during the front half of the multiple primary recording scans, or the first of the multiple primary recording scans. For this purpose, it is preferable to prepare multiple sets of mask patterns, which are different in the ratio with which the specific ink is permitted to be applied at least during the front half of the multiple primary recording scans, or during the last of the multiple recording scans, so that one of the mask pattern can be selected from among the multiple masks different in pattern. Obviously, it is also the information regarding the specific and nonspecific inks applied to each unit pixel that is used as the information for selecting the mask pattern. In the case of the structural setup of this type, it is preferable that the pattern is selected so that the smaller the ratio (=A/B) of the amount A by which the specific ink is applied, to the amount B by which the nonspecific ink(s) is applied, the higher the selected pattern, in the ratio with which the specific ink is permitted to be applied at least during the front half of the multiple primary recording scans, or the last of the multiple primary recording scans.

It is also desirable that whether or not to carry out the process for making the recording permission ratio for the specific ink higher than that for the nonspecific inks at least during the front half of the multiple primary recording scans, or the last of the multiple primary recording scans, is determined based on the information such as those described above. By making decision based on the above described information, it is possible to increase, as necessary, the ratio with which the specific ink is applied during the prior primary recording scan(s) to the primary recording scan(s) for the nonspecific ink(s).

Incidentally, in a case where the number of the primary recording scans in the latter (or front) half of the multiple primary recording scans is one, the "recording permission ratio during the latter (or front) half of the primary recording scans" means the recording permission ratio for this one and only primary recording scans. Further, in a case where the number of the primary recording scans in the latter (or front) half of the multiple primary recording scans is two or more, the "recording permission ratio during the latter (or front) half of the primary recording scans" means the sum or average value of the two or more recording permission ratios which correspond, one for one, to the multiple primary recording scans in the latter half (or front half) of the multiple scans. Further, "the recording permission ratio for the specific ink in the last (or first) primary recording scan" means the recording permission ratio for the specific ink, for the last (or first) primary recording scan.

FIG. 6 is a drawing for describing the general structure of the ink jet recording apparatus used in the preferred embodiments of the present invention. A carriage 11, on which an ink jet recording head and an ink container for multiple inks different in color (ink containers for multiple inks, one for one, different in color) is reciprocally moved in the primary scan direction by a carriage motor 12 as a carriage driving power source. A flexible cable 13 attached so that it can accommodate the reciprocal scanning movement of the carriage 11 allows electrical signals to be exchanged between an unshown control portion of the ink jet recording apparatus and the recording head on the carriage 11. As for the detection of the position of the carriage 11, the ink jet recording apparatus is structured so that the carriage position can be detected as an encoder sensor, with which the carriage 11 is provided, reads an encoder 16 attached to the main assembly of the recording apparatus in a manner to extend parallel to the direction of the primary scan.

As a recording operation start command is inputted from a host apparatus externally connected to the ink jet recording apparatus, one of the sheets of recording medium stored in layers in a sheet feeder tray 15 is fed to the position where an image can be recorded on the sheet of recording medium by the recording head on the carriage 11. Then, an intended image is formed, in sequential parallel strips, on the sheet of recording medium, by the alternate repetitions of the movement which the recording head makes in the primary scan direction while jetting ink according to the binary image formation data, and the conveyance of the recording medium by a preset amount.

The ink jet recording apparatus is provided with a recovery means 14 for carrying out the maintenance operation for the recording head. The recovery means 14 is located at one end of the moving range of the carriage 11. It is provided with: a cap 141 for suctioning ink through the nozzles and protecting the recording head surface where the nozzles open, while the ink jet recording apparatus is left unused; an ink catcher 142 for catching the image protection liquid jetted during a recording head performance (ink jetting performance) restoration operation; an ink catcher 143 for catching the inks jetted during the recording head performance (ink jetting performance) restoration operation; etc. A wiper blade 144 wipes the recording head surface having the nozzle openings while moving in the direction indicated by an arrow mark.

FIG. 7 is a block diagram for describing the structure of the control system of the ink jet recording apparatus shown in FIG. 6. Designated by a referential number 301 is a system controller which processes the image data received from an external device, such as a host computer 306 or the like. The system controls also the overall operation of the ink jet recording apparatus. The system controller 301 is made up of a microprocessor and a storage portion. The storage portion has: ROMs in which the control programs, mask patterns, index patterns (dot placement patterns, which will be described later), etc., are stored; and RAMs, or the like, which serve as work areas used when various image processing operations are carried out. For example, the system controller 301 determines, per primary recording scan, whether or not the binary image data stored in the frame memory 308 is to be accepted, with the use of the mask patterns stored in the ROMs, and stores the decisions in the buffer 309. To describe in more detail, binary data, based on which the portions of the image are to be recorded during each primary recording scan, is created by calculating the logical product between the mask pattern read out of the storage portion (ROM), and the above described binary image data, and the created data are stored in the buffer 309. Designated by a referential number 12 is a carriage motor for moving the carriage 11, on which the recording head is present, in the primary scan direction. Designated by a referential number 305 is a conveyance motor for conveying recording medium in the secondary scan direction. Designated by referential numbers 302 and 303 are drivers, which drive the motors 12 and 305, respectively, based on the information, such as the moving speed of the recording head, moving speed of recording medium, which they receive from the system controller 301.

Designated by a referential number 306 is the externally connected host apparatus, which transfers the information of an image (to recorded), to the ink jet recording apparatus in this embodiment. As for the form of the host apparatus 306, the host apparatus 306 may be a computer as an information processing apparatus, or an image reader. Designated by a referential number 307 is a reception buffer for temporarily store the data from the host apparatus 306. The reception buffer 307 stores the received data until the data are read by the system controller 301.

Designated by referential numbers 308 (308*k*, 308*c*, 308*m*, and 308*y*) are frame memories for developing the nonbinary image data transferred from the reception buffer 307, into binary image data. The frame memory 308 is large enough in capacity to store image data for each ink. In this embodiment, the frame memory 308 is large enough to store the image data equivalent to a single sheet of recording medium. Needless to say, the frame memory 308 is not limited in size. Designated by referential numbers 309 (309*k*, 309*c*, 309*m*, and 309*y*) are buffers for temporarily storing the binary image data for each ink. The storage capacity of the buffers 309 corresponds to the nozzle count of the recording head.

Designated by a referential number 310 is a recording operation controlling portion, which controls the recording head 17, in recording speed, recording data count, etc., in response to the commands from the system controller 301. Designated by a referential number 311 is a recording head driver, which is controlled by the signals from the recording operation controlling portion 310. The recording head driver 311 actuates the recording head 17 in order to make the recording head 17 jet inks.

As image data are supplied from the host apparatus 306 to the ink jet recording apparatus structured as described above, the image data are transferred to the reception buffer 307, and are temporarily stored therein. Then, they are developed by the system controller 301, into the frame memory 308 for each color (ink). Then, the developed image data are read out, and are subjected to a preset image processing operation, by the system controller 301. During the final stage of this preset image processing operation, the image data are subjected to master pattern processing steps, and then, the binary data which controls whether or not each ink is permitted to be applied during each of the multiple primary recording scans, is developed into the buffers 309. The recording operation controlling portion 310 controls the operation of the recording head 17 based on the binary data in each buffer.

FIG. 8 is a schematic drawing the recording head 17 used in this embodiment, as seen from the side where the outward end of each nozzle is open. The recording head 17 in this embodiment has multiple columns of nozzles. The number of nozzle columns corresponds to the number of inks used by the recording head 17. The nozzle columns are parallel to the secondary scan direction of the recording head 17, and are arranged in tandem in the primary scan direction. Each nozzle column has 1280 nozzles, and its nozzle density is 1,200 per inch. To describe in more detail, the recording head 17 has: nozzle column 4K for jetting black ink; nozzle column 4C for jetting cyan ink; nozzle column 4M for jetting magenta ink; and nozzle column 4Y for jetting yellow ink. The four nozzle columns 4K, 4C, 4M, and 4Y are arranged in tandem in the primary scan direction, and in parallel to each other. The amount by which ink is jetted per jettison from each nozzle is roughly 4.5 pl. However, the nozzle for jetting black ink may be made slightly larger in the amount by which ink is jetted per jettison than the other nozzles, in order to yield an image, which is higher in image density across the areas made up of black ink. The recording apparatus in this embodiment is structured as described above. Thus, it can recording dots at a recording density of as high as 2,400 dpi (dot/inch: referential value) in terms of the primary scan direction, and 1,200 dpi in terms of secondary scan direction, by moving the recording head in the primary scan direction while jetting inks.

Next, the ingredients of each ink of the ink set used in this embodiment, and the method for producing the inks used in this embodiment, will be described.

<Yellow Ink>

(1) Production of Liquid Dispersant

First, the following pigment (10 parts), anionic high polymer (30 parts), and pure water (60 parts) are mixed:

Pigment: C.I. pigment yellow 74 (Hansa Brilliant Yellow 5GX (product name of Clariant (Japan) K.K)

Anionic high polymer P-1: copolymer of styrene/butyl alcohol/acrylic acid (copolymer ratio (weight ratio)=30/40/30, 202 in acid value, 6,500 in weight average molecular weight, 10% water solution, potassium hydroxide (neutralizer)) 30 parts Next, the following ingredients are placed in a vertical sand mill of the batch type (product of Imex Co., Ltd.), and then, the sand mill is filled with 150 parts of zirconia beads (0.3 mm in diameter). Then, the mixture is stirred, while being water cooled, for 12 hours to evenly disperse the ingredients. Then, the large particles are removed by placing the mixture in a centrifugal separator, obtaining thereby the final product, in which pigments 1, which are 120 nm in weight average diameter and roughly 12.5% in solid content. Then, the obtained pigment mixture was used to make ink with the use of the following method:

(2) Ink Production

The following ingredients are thoroughly mixed, stirred, dissolved, and dispersed. Then, the mixture was filtered with a Microfilter (product of Fuji Film), which was 1.0 μm in pore size, while applying pressure, obtaining thereby Ink 1.

Pigment containing mixture 1:40 parts

Glycerine: 9 parts

Ethylene glycol: 6 parts

Acetylene glycol ethylene oxide (acetylene derivative) (product name: Acetylenol EH): 1 part 1,2-hexane diol: 3 parts Polyethylene glycol (1,000 in molecular weight): 4 parts Water: 37 parts <Magenta Ink>

(1) Production of Liquid Dispersant

The ingredients were benzyl acrylate and methacylic acid. First, block polymer of A-B type, which was 300 in acid value, and 2,500 in numerical average molecular weight, was made, using one of the ordinary method. Then, the block polymer was neutralized with water solution of potassium hydroxide, and then, was diluted with ion exchange water, obtaining thereby homogenous water solution of the block polymer, which is 50% in mass. Then, 100 g of the above described water solution of the polymer was mixed with 100 g of C.I. pigment red 122, and 300 g of ion exchange water. Then, the mixture was mechanically stirred for 0.5 hour. Then, the mixture was put through five times through an interaction chamber under a liquid pressure of roughly 70 Mpa, with the use of a micro-fluidizer. Further, the ingredients, inclusive of large particles of magenta pigment, which do not remain dispersed in the thus obtained liquid, in which the pigment red particles had been dispersed, were removed with the use of a centrifugal separated (for 20 minutes at 12,000 rpm). The obtained liquid in which magenta pigments remained dispersed was 10% (mass) in pigment and 5% (mass) in dispersant density.

(2) Ink Production

Ink was made from the above described liquid in which magenta pigments were dispersed. To this liquid, the following ingredients were added so that the density of the mixture became as preset. After the mixture of these ingredients were thoroughly mixed by stirring, the mixture was filtered under pressure with a Microfilter (product of Fuji Film), which was 2.5 μm in pore size, yielding pigment ink, which was 4% (mass) in pigment density and 2% (mass) in dispersant density.

Magenta pigment containing liquid mixture 1:40 parts

Glycerine: 10 parts

Di-ethylene glycol: 10 parts

Acetylene glycol ethylene oxide (acetylene derivative) (product name: Acetylenol EH): 0.5 part Ion exchange water (product of Kawaken Fine Chemicals Co., Ltd.): 39.5 parts.

<Cyan Ink>

(1) Production of Mixture of Liquid Dispersion Medium and Cyan Pigments

The materials for the liquid dispersion medium are benzyl acrylate and methacylic acid. First, block polymer of A-B type, which was 2,500 in acid value, and 3,000 in numerical average molecular weight, was made, using one of the ordinary method. Then, the block polymer was neutralized with water solution of potassium hydroxide, and then, was diluted with ion exchange water, obtaining thereby homogenous water solution of the block polymer, which was 50% in mass.

Then, 180 g of the above described water solution of the polymer was mixed with 100 g of C.I. pigment blue 153 and 220 g of ion exchange water. The mixture was mechanically stirred for 0.5 hour. Then, the mixture was put through five times through an interaction chamber under a liquid pressure of roughly 70 Mpa, with the use of a micro-fluidizer. Further, the ingredients, inclusive of large particles of magenta pigment, which did not remain dispersed in the thus obtained liquid, in which the pigment red particles were dispersed, were removed with the use of a centrifugal separated (for 20 minutes at 12,000 rpm). The obtained liquid in which cyan pigments remained dispersed was 10% (mass) in pigment density and 10% (mass) in dispersant density.

(2) Ink Production

Ink was made from the above described liquid in which cyan pigments remained dispersed. To this liquid, the following ingredients were added so that the density of the mixture became as preset. After the mixture of these ingredients were thoroughly mixed by stirring, the mixture was filtered under pressure with a Microfilter (product of Fuji Film), which was 2.5 μm in pore size, yielding pigment ink, which was 2% (mass) in pigment density and 2% (mass) in dispersant density.

Cyan pigment containing liquid mixture: 20 parts
Glycerine: 10 parts
Di-ethylene glycol: 10 parts
Acetylene glycol ethylene oxide (acetylene derivative): 0.5 part
Ion exchange water (product of Kawaken Fine Chemicals Co., Ltd.): 53.5 parts <Black Ink>

(1) Production of Liquid Dispersant>

100 g of the above described water solution of the polymer, which was used for the production of yellow ink 1, was mixed with 100 g of carbon black, and 300 g of ion exchange water. Then, the mixture was mechanically stirred for 0.5 hour. Then, the mixture was put five times through an interaction chamber under a liquid pressure of roughly 70 Mpa, with the use of a micro-fluidizer. Further, the ingredients, inclusive of large particles of magenta pigment, which did not remain dispersed in the thus obtained liquid, in which the pigment black particles were dispersed, were removed with the use of a centrifugal separated (for 20 minutes at 12,000 rpm). The obtained liquid in which black pigments remained dispersed was 10% (mass) in pigment density and 6% (mass) in dispersant density.

(2) Ink Production

Ink is made from the above-described liquid in which black pigments remained dispersed. To this liquid, the following ingredients were added so that the density of the mixture became as preset. After the mixture of these ingredients were thoroughly mixed by stirring, the mixture was filtered under pressure with a Microfilter (product of Fuji Film), which was 2.5 μm in pore size, yielding pigment ink, which was 5% (mass) in pigment density and 3% (mass) in dispersant density.

Mixture of liquid dispersant and black pigment: 50 parts
Glycerine: 10 parts
Tri-ethylene glycol: 10 parts
Acetylene glycol ethylene oxide (acetylene derivative): 0.5 part
Ion exchange water (product of Kawaken Fine Chemicals Co., Ltd.): 25.5 parts The results of the test carried out by the inventors of the present invention in order to examine the difference in friction resistance among the inks described above are given in Table 1. In this test, the friction resistance was subjectively evaluated based on how easily the images formed with the use of these inks became scarred when scratched with nails. In the table, G means that the images were not scarred at all; F means that the images were slightly scarred; and NG means that the images peeled. The recording medium used in this test was glossy photographic paper (product of Canon: glossy photo-paper [thin] LFM-GP421 R (commercial name)). The above-described patches were recorded with the use of a recording method, in which each of the regions 1-8 of the recording head were equal in recording ratio. Each patch was recorded by eight passes (mask pattern which made each pass 12.5% in recording ratio).

TABLE 1

| Inks | Friction resistance |
|---|---|
| Black | NG |
| Cyan | F |
| Magenta | F |
| Yellow | G |

G: Good in friction resistance
F: Slightly poor in friction resistance
NG: Poor in friction resistance It is evident from Table 1 that in the case of the set of inks in this embodiment, the yellow ink was superior in friction resistance to the other inks. It may be thought that the reason therefor is that the coefficient of friction between the portion of the recording medium surface covered with the yellow ink and the nails was lower than the portion of the recording medium surface covered with any of the other inks and the nails.

Next, the inventors of the present invention carried out a test for studying the friction resistance of green (secondary color) images, which were formed with the use of the cyan and yellow inks. In the test, three kinds of image, which were different in the order in which the cyan and yellow inks were applied. The method used for testing the images was the same as that was used to obtain the results shown in Table 1. More specifically, the patches were record by applying both the cyan and yellow inks at 100% (total of 200%), under that same condition as that was used to test the black, cyan, magenta, and yellow inks. In order to control the order in which inks were applied, two kinds of mask pattern were created, which were specific in form. One kind of mask pattern (mask pattern 1) was such that cyan ink was applied at a ratio of 25% (therefore, total ratio of 100%) during each of the front four passes, and then, yellow ink was applied at a ratio of 25% (therefore, total ratio of 100%) during each of the latter four passes). Another mask pattern (mask pattern 2) was opposite in the relationship between the two inks. There was also prepared an ordinary mask pattern (mask patter 3), which allowed both yellow and cyan inks to be applied at a ratio of 12.5% per pass. Then, the green images formed with the use of the cyan and yellow inks and the three kinds of mask pattern were tested for friction resistance. The obtained results were shown in Table 2.

TABLE 2

| Order of printing | Friction resistance |
|---|---|
| Simultaneous cyan and yellow (Mask pattern 3) | F |
| Cyan and then yellow (Mask pattern 1) | G |
| Yellow and then cyan (Mask pattern 2) | NG |

G: Good in friction resistance
F: Slightly poor in friction resistance
NG: Poor in friction resistance (Table 2: Relationship between friction resistance, and order in which inks were applied)

It is evident from Table 2 that even though two kinds of green image were the same in appearance, those formed by apply yellow ink after cyan ink were superior in friction resistance. It may be reasonable to think that this result is attributable to the fact that applying the yellow ink after the cyan ink yielded images, the surface of which was lower in frictional resistance than those formed by applying the yellow ink before the cyan ink. It may also be reasonable to think that the reason why applying the yellow ink before the cyan ink resulted in the formation of the green images which were inferior in friction resistance than the green images formed by applying the yellow ink after the cyan ink is that as the cyan ink was applied on the layer of the yellow ink, it did not firmly bond to the layer of the yellow ink.

Based on the result of tests given above, the inventor of the present invention determined that in a case where yellow ink is mixed with ink of another color, or inks of other colors, to yield ink of secondary color, increasing yellow ink in the ratio with which it is applied after the other inks, is effective to yield an image which is higher in friction resistance. However, always applying the yellow ink only during the latter half passes in order to apply the yellow ink as late as possible compared to the other inks makes the nozzles uneven in the frequence of usage, and/or makes unnecessarily uneven the recording passes of the ink jet head across recording medium. It is desired that causing the unnecessarily higher level of unevenness is avoided as much as possible.

The inventors of the present invention reached the following conclusion through the ardent study of the results of the tests: In order to yield an image, which is superior in friction resistance while preventing the unevenness among the nozzles in terms of usage and the unevenness among the recording passes (scans) in terms of recording ratio, it is effective to change the passes (scans) for applying yellow ink from the default setup only when a set of preset conditions are met. To describe in more detail, making the mask pattern changeable per unit pixel so that the yellow ink is applied during as late as possible passes, or during the last pass, only for the areas (unit pixels) of recording medium, which satisfy the conditions under which the yellow ink is applied along with another ink or other inks.

Incidentally, in this specification, the ink(s) which is switched in the order of application based on whether it is applied to yield a unit pixel which satisfies the preset conditions, or a unit pixel which does not satisfy the preset conditions, is defined as "specific ink". The number of "specific inks" is not limited to one; it may be two or more. On the other hand, any of the inks other than the "specific ink" are defined as a "nonspecific ink". In the case of the present invention, yellow ink comes under the definition of "specific ink", whereas cyan, magenta, and black inks come under the definition of "nonspecific ink". Also in this embodiment, yellow ink, which is excellent in friction resistance, is listed as the specific ink. However, the selection of inks which are excellent in friction resistance is not limited to yellow ink. That is, if cyan ink, magenta ink, etc., could meet certain criteria, they might be inks which are excellent in friction resistance. In such a case, the cyan and magenta inks, which are excellent in friction resistance, come under the definition of "specific ink".

Hereafter, the concrete structural setup for making it possible to carry out the control, which characterizes this embodiment of the present invention, will be described. FIG. 9 is a flowchart for concretely describing the steps in the image processing operation carried out by the host apparatus in this embodiment. Each of the rectangles in the drawing represents an image processing step, whereas each of the ovals in the drawing indicates the format of the data exchanged between the image processing steps.

Generally, first, the printer driver installed in the host apparatus receives pixel data having the RGB (red, green, blue) data 101 from application software, or the like. Then, in a resolution changing step 102, it converts the pixel data into RGB data 103, which are proper in resolution to be outputted to the recording apparatus. The resolution after this conversion is different from the final resolution (2,400 dpi×1,200 dpi), that is, the resolution with which the recording apparatus records dots. In the following step, or a color adjustment step 104, the print driver adjusts in color the RGB data 103 of each pixel to create R'G'B' data 105, which are suitable for the recording apparatus. In this color adjustment step 104, a lookup table, which has been prepared in advance, is referenced.

In a color separation step 106, the R'G'B' data 105 are converted into density data for CMYK (cyan, magenta, yellow, and black), which correspond to the colors of the inks used by the recording apparatus. Generally, also in the color separation step, a lookup table is referenced. As for a concrete color conversion method, a certain portion of the nonchromatic components of the RGB data is replaced with K (black), while the RGB data are replaced with CMY (complementary colors, respectively, of RGB). The density data 107 obtained in the color separation step 106 are 8 bit data, which have 256 levels of tone. However, in a 4 bit data conversion step 108, the density data 107 are converted into density data 109, which have 9 levels of tone which are expressed in 4 bits. As a multi-value (nonbinary) conversion, such as this one, an ordinary nonbinary error dispersion process can be employed. In this step, the density data which have 9 levels of tone which are expressed in 4 bits, are density data having 9 levels of tone which have values of 0000-1000 in binary system.

On the other hand, the 8 bit density data for CMYK, which were created in the color separation step 106, are also used in a mask selection parameter computation step 110, in which a mask selection parameter MP 111, which has information made up of 0 or 1, is selected by computation, with reference to the density data for four colors.

FIG. 10 is a flowchart for describing the sub-steps in the mask selection step 110 for obtaining the mask selection parameter 111 by computation. As the density data which have 256 levels of tone for each of CMYK are received, first, new density data C'M'Y'K' 1102 are obtained by multiplying these data with weighting coefficients, which have a value of 0 or 1, and omitting the resultant fractions. Next, in a computation step 1103, an intermediary mask selection parameter MP' 1104 is obtained by calculation. That is, the intermediary mask selection parameter MP' is obtained using an equation (MP'=C'+M'+Y'+K'+B), in which B stands for a constant (which is 128), and omitting the last three digits. Thus, the obtained parameter has 5 bits (32 values).

Table 3 shows the density data CMYK used in the mask selection parameter computation step 110, and intermediary numerical values which resulted during the process for obtaining the intermediary mask selection parameter MP' from the combinations of these data. In this embodiment, the coefficients for weighting the C, M, and K are set to 0.16, and the coefficient for weighting the Y is set to 0.5. Further, the constant B used in the computation step 1103 is set to 128. As will be evident from the table, in a case where the ratio (A/B) of a density A for Y (amount by which Y is applied) relative to the density B for the other colors (amount by which C, M, and Y are applied) is small, the value of the intermediary mask selection parameter MP' is likely to be relatively large. On the other hand, in a case where the ratio of the density value A of Y to the density value B of the other colors, the is, A/B, is small, the value of the intermediary mask selection parameter MP' is likely to be relatively large. That is, the intermediary mask selection parameter MP' is related to the relationship between the specific ink and nonspecific ink(s); the smaller the above described ratio (A/B), the larger the MP' is likely to be, and therefore, the larger will be the probability with which a pattern (mask pattern B) which is relatively high in the record permission ratio during the latter half of the passes (scans) is selected, as will be

TABLE 3

| | | Dnsty data | Weighting co-efficient | Cal. Result of Wtg. | Cal. cnst. | Cal. Result | MP' lower 3 bits neglected |
|---|---|---|---|---|---|---|---|
| Data Ex. 1 | C | 255 | C: 0.16 | 40 | 128 | 238 | 29 |
| | M | 255 | M: 0.16 | 40 | | | |
| | Y | 20 | Y: 0.5 | 10 | | | |
| | K | 255 | K: 0.16 | 40 | | | |
| Data Ex. 2 | C | 20 | | 3 | | 132 | 16 |
| | M | 20 | | 3 | | | |
| | Y | 20 | | 10 | | | |
| | K | 50 | | 8 | | | |
| Data Ex. 3 | C | 0 | | 0 | | 1 | 0 |
| | M | 0 | | 0 | | | |
| | Y | 255 | | 127 | | | |
| | K | 0 | | 0 | | | |

described later.

Described above, various computations are made for each pixel, following the flowchart in FIG. 10. As long as the relationship between the input values of CMYK and the output value MP' is set as straightforward as shown in Table 3, a lookup table like Table 3 may be prepared in advance, and the intermediary mask selection parameter MP' may be selected by referring to the lookup table.

As the intermediary mask selection parameter 1104 is obtained by calculation, a one bit (binary) mask selection parameter MP 111 is obtained by in a binarization step 1105. As the binalizing process used in the binalizing step 1105, an ordinary error diffusing method or dithering method may be used.

The 4-bit density data for each color, and mask selection parameter MP111, which are obtained in the sequence of steps described with reference to FIG. 9, are outputted to the recording apparatus. Next, referring to FIG. 7, after the reception of the output data 109 and mask selection parameter MP 111 by the recording apparatus, they are temporarily stored in the reception buffer 307 of the recording apparatus, and then, the output data 109 are transferred into a frame memory 308 by the system controller 301.

FIG. 13 is a flowchart for describing the steps in the image processing operation carried out upon the above described data by the system controller 301. First, in an index development step 1306, the system controller 301 converts the 4-bit data 109 for each color, into data 1307, with the use of index patterns stored in advance in the ROM.

FIG. 19 is a schematic drawing for describing one of the ordinary index development routines. An index developing routine is a routine for converting the multi-value (nonbinary) gradation data (having several levels) inputted from the host apparatus or the like, into binary data, which indicate whether a given dot is to be recorded by the recording apparatus or not. The binary values 0000-1000, which are in the left column in the drawing are 4-bit values in the data inputted from the host apparatus. In the case of this embodiment, the data in this stage are equivalent to 600 dpi in resolution. In this specification, a unit pixel (which is nonbinary (multi-value pixel) which has several levels of gradation inputted from host apparatus)), will be referred to as "unit pixel". That is, a unit pixel corresponds to the smallest unit (area) of an image, the gradation level of which can be controlled (expressed). As for the patterns in the right column of the table in FIG. 19 are the dot patterns which show the number of dots to be actually recorded (or not recorded) and the positioning of the dots to be recorded. The squares in each pattern are arranged at a resolution of 2,400 dpi (primary scan direction)×1,200 dpi (secondary scan direction). In this specification, hereafter, each of these square units (smallest unit of image, which can be recorded or not by recording apparatus) is referred to as "pixel". A black square corresponds to a pixel which will be covered with a black dot (pixel to be recorded), whereas a white square corresponds to a pixel which will not be covered with a black dot (pixel not to be recorded). That is, in the case of this embodiment, each set of pixels, or "unit pixel", corresponds to a group of 4×2 pixels. Referring again to the drawing, the greater the value of the gradation data which each pixel has, the greater (by one) the number of pixels to be recorded (number of black squares) in a set of 4×2 pixels.

By employing an index developing process such as the one described above, it is possible to reduce the amount of the load to which the host apparatus is subjected for image processing, and the amount of the data which have to be transferred from the host apparatus to the recording apparatus. For example, in order to accurately specify which pixels among all the pixels in each of the groups of 4×2 pixel sets, information equivalent to 8 bits is necessary. That is, in order for the host apparatus to inform the recording apparatus of the data regarding a set of 4×2 pixels, the host apparatus has to transfer information which is equivalent to 8 bits. However, if the recording apparatus is provided with an index pattern, such as the one shown in FIG. 19, which is stored in advance in the apparatus, it is only the gradation data for each set of pixels, which is 4-bit information, that the host apparatus has to transfer. In other words, the amount of data is half the amount of data which has to be transferred in a case where the index is not developed. Therefore, the length of time necessary for the transfer is shorter.

FIG. 11 is a schematic drawing for describing the actual index patterns (dot patterns) used in this embodiment. In the drawing, the gradation data 0000-1000, which are on the left side of the actual drawings, are actual values of 4-bit data for each color. In this embodiment, eight index patterns are prepared for each gradation datum. For example, for the gradation datum 0001 in FIG. 11, index patterns 1*a*-1*h* are prepared. It is only one among the eight index patterns that is employed for each set of pixels in an actual recording operation. However, by preparing multiple index patterns as in this embodiment makes it possible to rotate the index patterns. That is, even in a case where gradation data which are the same in value are continuously inputted, the dots can be variously position by mixing and rotating various index patterns, and therefore, it is possible to form an image which does not conspicuously show the effects of the nonuniformity in terms of ink jetting performance among the nozzles, and the various imperfections of the recording apparatus. Also in this embodiment, the eight different index patterns shown in the drawing are used in rotation in terms of the primary scan direction. For example, if the recording apparatus is instructed to sequentially record three pixels, the gradation data of which are 0001, 0001, and 0001, in terms of the primary scan direction, the output patterns are 1*a*, 1*b*, and 1*c*, respectively. Further, if the recording apparatus is instructed to sequentially record three pixels, the gradation data of which are 0001, 0010, and 0001, the output patterns are 1*a*, 2*b*, and 1*c*, respectively. Referring again to FIG. 13, with the use of the index development process 1307, such as the one described above, binary image datum 1307, which corresponds to one bit recording element for each color, is obtained.

The following steps 1308-1312 are steps for selecting one of the two mask patterns stored in the ROM, and producing recording data used for recording dots during each recording pass (scan). More specifically, first, in Step 1308, it is determined whether the data to be processed is for yellow. It if it is determined that the data to be process is for colors other than yellow, Step 1311 is taken, in which a recording datum 1312 is produced with the use of the mask pattern A. In other words, in the case of the data for cyan, magenta, and black, the mask pattern A, which is less uneven in recording permission ratio among recording passes (scans) is selected, whereby the recording permission ratio for each recording pass (scan) for cyan, magenta, and black is set by this selection.

On the other hand, if it is determined in Step 1308 that the datum to be processed is for yellow, Step 1309 is taken, in which the mask selection parameter MP111 for a target unit pixel is checked in value. If MP=1, Step 1301 is taken, in which a recording datum 1312 is generated with the use of the mask pattern B. If MP=0, Step 1311 is taken, in which a recording datum 1312 is generated with the use of the mask pattern A. That is, in the case of yellow color, the mask pattern A, or the mask pattern B which is greater in the recording permission ratio during the latter half of recording passes (scans) than the mask pattern A, is selected based on the information regarding the yellow ink and the inks other than the yellow ink, applied to each unit pixel. Further, by selecting the mask pattern as described above, it is possible to variably set the recording permission ratio for each primary recording pass (scan) for applying yellow ink. The relationship between the mask selection parameter MP generated as described above, and the mask pattern to be used, is as shown in Table 4.

TABLE 4

| Ink color | Mask selection parameter | Mask used |
|---|---|---|
| Cyan | — | Mask A |
| Magenta | — | Mask A |
| Yellow | 0 | Mask A |
| | 1 | Mask B |
| Black | — | Mask A |

FIGS. 12(*a*) and 12(*b*) are drawings for describing the details of the mask patterns A and B, respectively. Regarding both drawings, designated by a referential number 71 are the nozzle columns, which are the same in the color of the inks they jet. They have 1,280 nozzles (ink jetting openings), which are arranged in the direction parallel to the secondary scan direction, at 1,200 dpi. These nozzles are separated into eight nozzle groups made up of consecutively positioned nozzles. The nozzle groups are used with mask patterns 73*a*-73*h*, or mask patterns 73*i*-73*p*, respectively, which are shown on the right side of the nozzle groups. For example, in the case of FIG. 12(*a*), the mask pattern 73*h*, which corresponds to the nozzle group 1, is the mask pattern for the first pass, and the mask pattern 73*g*, which corresponds to the nozzle group 2, is for the mask pattern for the second pass, and so on. That is, the nozzle group number and pass number correspond with each other one for one. Each square of each mask pattern corresponds to a single dot. A black square means that the mask pattern permits the recording of a dot (recording permission pixel), whereas a white square means that the mask pattern does not permit the recording of a dot, which corresponds to the white square, to be recorded (recording-prohibited pixel). Which recording element is to be actually given a dot during each recording pass (scan) is determined based on the logical multiplication between the binary image data 1307 (1-bit data for CMYK) after the index development, and the selected mask pattern. Thus, each portion of an image, which corresponds to a given (preset) area of recording medium, is completed by scanning the area eight times in the primary scan direction.

In the case of the mask pattern A in FIG. 12(*a*), the patterns 73*a*-73*h*, which correspond to eight nozzle groups, one for one, are equal in recording permission ratio, which is 12.5%. They are also complementary among themselves. On the other hand, in the case of the mask pattern B in FIG. 12(*b*), the patterns 73*i*-73*p* are unequal in recording permission ratio, although they are also complimentary among themselves. In the case of the mask pattern B, the upstream half of the mask patterns in terms of the direction parallel to the recording medium conveyance direction are 6.25% in recording permission ratio, which is rather low, and the downstream mask patterns are 25% in recording permission ratio, which is rather high. This means that the unit pixel for which this mask pattern is employ is highly likely to be recorded during the relatively late passes among the multiple passes. That is, in this embodiment, the smaller the unit pixel in the ratio of the density value of yellow to the density value of the other colors, the more likely the mask selection parameter MP is to be 1 (that is, more likely mask pattern B is selected), and the higher the probability with which yellow ink is applied later than the other inks. On the other hand, in the case of a unit pixel which is greater in the ratio of the density value of yellow to the density value of the other colors, the mask pattern A, which is uniform in the recording permission ratio, is likely to be selected. Incidentally, the mask pattern A in FIG. 12 makes all the passes uniform in recording permission ratio. However, it is not mandatory that the mask pattern A makes all the passes uniform in recording permission ratio; the mask pattern A may be such that it does not make all the passes uniform in recording permission ratio. What is essential here is that the mask pattern A is smaller in the recording permission ratio for the latter half of the primary recording passes or the last pass than the mask pattern B.

In FIGS. 12(*a*) and 12(*b*), the mask patterns have been simplified, having 16 pixel in terms of the primary scan direction and 4 pixels in terms of the secondary scan direction. However, a real mask pattern has 160 pixels, for example, even in terms of the secondary scan direction, and even greater number of pixels in terms of the primary scan direction.

To summarize, the image processing sequence shown in FIG. 13 is repeatedly carried out for each of the unit pixels arranged at 600 dpi. That is, in this embodiment, the mask pattern can be switched per unit pixel.

FIG. 14 is a drawing for describing the density datum 109, mask selection parameter MP, mask pattern, and an example of a recording datum obtainable from the preceding variables. Drawings 141C-141K represent 4-bit density data 109 of cyan (141C), magenta (141M), yellow (141Y) and black (141K), respectively, before the index development. Each of the areas A and B has four pixels (=2 pixels×2 pixels). To each pixel, a 4-bit density datum corresponds.

The drawings 142C-142K represent binary data after the index development of the density data 109 of 141C-141K, respectively. As described above, each unit pixel in this embodiment is made up of eight pixels. Whether or not each pixel is to be recorded is determined by converting the density data 141C-141K into index patterns (dot patterns) such as those shown in FIG. 11.

Designated by a referential symbols 143MP is the mask selection parameter MP obtained by calculation based on the image data of 141C-141K. The ratio of the Y signal value (141Y) of the area A to the CMK signal value (sum of 141C, 141M, and 141K) is relatively small. Therefore, the mask selection parameter MP becomes 1 for three unit pixels among the four unit pixels in the area A. That is, as the mask pattern used for recording the yellow ink in the area A, the mask pattern B is selected for the three unit pixels among the four unit pixel, and the mask pattern A is selected for the remaining one. On the other hand, the ratio of the Y signal value (141Y) in the area B to the CMK signal value (sum of 141C, 141M, and 141K) is relatively high. Therefore, the mask selection pattern MP becomes 0 for all of the four pixels. Therefore, as the mask pattern to be used for recording the yellow ink for the area B, the mask pattern A is selected for all of the four pixels.

Referential symbols 144A and 144B correspond to the mask patterns A and B, which correspond to the area 8 (group 8) in FIGS. 12(*a*) and 12(*b*), respectively. The mask pattern A (144A) is 12.5% in recording permission ratio, whereas the mask pattern B (144B) is 25% in recording permission ratio. That is, in this embodiment, in the case of yellow, the mask pattern A is used for one of the unit pixel in the area B and all the unit pixels in the area B, whereas the mask pattern B is used only for the three unit pixels in the area B. On the other hand, in the case of the black, cyan, and magenta, the mask pattern A is used for all the unit pixels in the areas A and B.

The drawings 145C-145K show the results of the logical multiplication of the binary data 142C-142K after the index development, and the mask pattern A (144A) or mask pattern B (144B), which is selected for each unit pixel. The drawings 144A and 144B show the portions of the mask patterns A and B, which correspond to the area 8, showing therefore the pixels permitted to be recorded during the last recording pass (scan). It is not always true that the value of the density signal of the yellow in the area A in the drawing 141Y is as great as expected than the density signal value of the other colors (141C, 141M, and 141K). However, the ratio of the pixels (dots) to be recorded during the last recording pass (scan), that is, the ratio of the black square in the area A of the 145Y, is larger than the that in the area A of the other colors (145C, 145M, and 145K). The reason for this is that in the case of yellow which is not as large in density data as it thought it would be than the other colors, the mask pattern is selected so that the last of the multiple passes will be as high as possible in the ratio of the amount of ink to be applied, by the sequences of processes described with reference to FIGS. 9, 10, and 13.

Table 5 shows the results (evaluations in terms of friction resistance and nonuniformity) of a test in which the mask pattern A was used for all the colors, a test in which the mask pattern B was used for all the unit pixel of yellow, and a test in which images were recorded in accordance with this embodiment.

TABLE 5

| | | | All masked | | CMK: Mask A and Y: Mask B | | Embodiment (Mixed) | | |
|---|---|---|---|---|---|---|---|---|---|
| | | | *1 | *2 | *1 | *2 | Mask | *1 | *2 |
| Data Ex. 1 | C | 255 | F | G | G | G | Mostly Msk B | G | G |
| | M | 255 | | | | | | | |
| | Y | 20 | | | | | | | |
| | K | 255 | | | | | | | |
| Data Ex. 2 | C | 20 | F | G | G | G | Half/Half | G | G |
| | M | 20 | | | | | | | |
| | Y | 20 | | | | | | | |
| | K | 50 | | | | | | | |
| Data Ex. 3 | C | 0 | G | G | G | F | Msk A only | G | G |
| | M | 0 | | | | | | | |
| | Y | 255 | | | | | | | |
| | K | 0 | | | | | | | |

*1: Friction resistance
*2: Image unevenness

Referring to Table 5, using the mask pattern B for all the unit pixels of only yellow increases the probability with which the yellow ink, which is greater in friction resistance than the other inks, is applied in a manner to cover the other inks. Therefore, it makes it possible to form an image, the entirety of which is superior in friction resistance. On the other hand, the mask pattern B makes the nozzles significantly nonuniform in usage frequency, which in turn reduces the merits of the multi-pass recording method. In particular, an image, the image data of yellow of which is high in density, will be recorded so that it will be conspicuously nonuniform.

In comparison, in this embodiment, for a unit pixel, which is relatively large in the ratio of the data value of yellow, to the data values of the other color, nonuniformity is taken more seriously than friction resistance, and therefore, the mask pattern A is selected, which is less in the nonuniformity in recording permission ratio among the multi-passes than the mask pattern B. On the other hand, for a unit pixel, which is relatively small in the data value of yellow, to the data values of the other colors, being therefore likely to be inferior in friction resistance, but, unlikely to be conspicuously nonuniform, the mask pattern B is selected, which is greater in the recording permission ratio during the latter half of recording passes (scans) or the last recording pass.

As described above, in this embodiment, the recording permission ratio for a specific ink (which in this embodiment is yellow ink) is made variable by selecting the mask pattern for the specific ink, based on the conditions (for example, information about amount by which ink is applied) under which the specific ink and nonspecific inks (inks other than yellow ink) are applied to each unit pixel to which the specific ink is to be applied. Thus, a unit pixel to which both the specific and nonspecific inks are applied is higher in the probability with which the specific ink is applied during the last half of the recording passes, or the last recording pass. Consequently, the probability with which the specific ink is applied during the later recording passes than the recording passes during which the nonspecific inks are applied, is higher. Thus, the specific ink, which is superior in friction resistance to the other inks, can be applied later than the other inks. Therefore, it is possible to form an image which is superior in friction resistance than an image formed with the use of the conventional recording method. In this embodiment, in order to achieve the above described effects, such a mask pattern that can make it possible to control only the order in which inks are applied to specific unit pixels is selected from among the multiple mask patterns prepared in advance.

Incidentally, the host apparatus in this embodiment described above was designed to transfer to the recording apparatus, the 4-bit data 109 generated by converting (Step 108) the 8-bit density data 107 obtained by separating (Step 106) optical image of the image to be recorded. Further, the recording apparatus (system controller) was designed to convert the received 4-bit data 109 into the binary data 1307 with the use of the index development process 1306. By designing the host apparatus and recording apparatus as described above, it is possible to reduce the amount of the data which the host apparatus has to process, and therefore, it is possible to reduce the length of time it takes for the data to be transferred to the recording apparatus. This embodiment, however, is not intended to limit the image processing steps to those described above. For example, the image processing steps may be such that the host apparatus converts the nonbinary (multi-value) density data 109 obtained by the color separation process 106 (step), into binary data, and then, transfers the binary image data (1,200 dpi×2,400 dpi) to the recording apparatus. Such a design can also provide the same effects as those which characterize this embodiment of the present invention, as the designs of the host apparatus and recording apparatus in this embodiment.

Further, in this embodiment, the image processing steps in FIG. 9 (flowchart) are carried out by the host apparatus, and processing steps in FIG. 13 (flowchart) are carried out by the recording apparatus. However, this embodiment is not intended to limit the present invention in terms of where these processing steps are carried out. For example, the present invention may be embodied so that all the processing steps shown in both FIGS. 9 and 13 are carried by the host apparatus alone, or the recording apparatus alone, instead of the combination of the host apparatus and recording apparatus.

(Embodiment 2)

Also in this embodiment, the same inks as those used in the first embodiment are used by the same ink jet recording apparatus as the one used in the first embodiment and shown in FIGS. 6-8 are used. Further, the image processing steps carried out by the host apparatus in this embodiment are roughly the same as those in the first embodiment, which were described using the flowcharts in FIGS. 9 and 10. However, in this embodiment, the 4-bit data conversion process 108 (step) is not carried out in the host apparatus. Instead, the density data 107 made up of the 8-bit data obtained for each color by the color separation process, and the mask separation parameter MP, are transmitted to the recording apparatus.

Further, in this embodiment, the recording apparatus does not prepare the binary mask patterns such as those in the first embodiment. Instead, it prepares mask patterns (recording permission ratio determining patterns) which determine only the recording permission ratio for each region of the recording head.

FIG. 15 is a schematic drawing for describing the structure of the mask pattern in this embodiment. Also in this embodiment, each nozzle columns has 1,280 nozzles (ink jetting openings) aligned in the secondary scan direction with a pitch of 1,200 dpi. These nozzles are separated into eight groups, which are in the eight sequential regions into which the nozzles column is separated. The recording permission ratio is set for each unit pixel, which is 600 dpi in resolution. The unit pixel is equivalent to (2 pixels (in secondary scan direction)×4 pixels (in primary scan direction)) of an image with a resolution of 1,200 dpi×2,400 dpi. The recording permission ratio of each nozzle group is set so that the sum of recording permission ratios for the eight nozzle groups becomes 100%.

FIGS. 16(*a*) and 16(*b*) are drawings for describing the two kinds of mask patterns, that is, a mask pattern A and a mask pattern B, prepared in this embodiment. In the case of the mask pattern A, which is shown in FIG. 16(*a*), all eight nozzle groups are 12.5% in recording permission ratio. On the other hand, in the case of the mask pattern B shown in FIG. 16(*b*), the recording permission ratio for the upstream half of the nozzle groups in terms of the secondary scan direction, that is, the recording medium conveyance direction, is set to a relatively low ratio of 7.5%, whereas the recording permission ratio for the downstream half of the nozzle groups is set to a relatively high ratio of 25%. This means that the unit pixel to which this mask pattern is applied is relatively high in the probability with which they are recorded during relatively late passes among the multiple passes. In this embodiment, it is made possible to switch between the two mask patterns, such as those described above, based on the multicolor image data.

FIG. 17 is for describing each of the image processing steps carried out by the system controller 301 of the recording apparatus in this embodiment.

In this embodiment, first, in Step 1701, it is determined whether the inputted 8-bit density data 107 is for yellow color or the other colors. If it is determined that the data is for the colors other than yellow, Step 1704 is taken, in which an output datum 1705 is generated with the use of the mask pattern A. That is, for cyan, magenta, and black, the mask pattern A is used, which is less nonuniformity in recording permission ratio among the multiple recording passes (scans).

On the other hand, if it is determined that the data to be processed is for yellow ink, Step 1702 is taken, in which the value of the mask selection parameter MP111, which corresponds to the unit pixel which includes this data, is confirmed. If MP=1, Step 1703 is taken, in which an 8-bit datum 1705 is generated with the use of the mask pattern B, which is greater in the recording permission ratio for the latter half of the recording passes (scans). If MP=0, Step 1704 is taken, in which an output datum 1705 is generated with the use of the mask pattern A. In this embodiment, the output datum 1705 is obtained by the multiplication between the 8-bit density data 107 for the pertaining unit pixel, and the recording permission ratio stored in the mask pattern A or mask pattern B. Thereafter, a 1-bit recording data 1707 is obtained by carrying out a binarization process 1706 (Step 1706). That is, a pixel (or pixels) into which a dot is to be recorded during each recording pass (scan) is determined.

The sequence of image processing steps shown in FIG. 17 is repeatedly carried out, that is, for every unit pixel, which is 600 dpi in resolution, as it is in the first embodiment. That is, also in this embodiment, the mask pattern can be switched for each unit pixel.

FIGS. 18(*a*)-(*g*) are drawings for explaining the 8-bit density data 107, mask selection parameter MP, mask pattern, and the example of the recording data 1707 obtainable from the proceeding variables. FIG. 18(*a*) is a schematic drawing of the unit pixel (4 pixel×4 pixel) of the density data 107 of yellow. Each unit pixel has 8-bit density data expressed in the form of 0-255.

FIG. 18(*b*) is a drawing which shows an example of the mask selection parameter MP for a unit pixel, which was obtained from the above described density data for the yellow, and the unshown density data for the other three colors (cyan, magenta, and black).

FIGS. 18(*c*) and 18(*d*) show the portions of the mask patterns A and B shown in FIGS. 16(*a*) and 16(*b*), which correspond to the regions 8, respectively. The mask pattern A is 12.5% in recording permission ratio, whereas the mask pattern B is 25% in recording permission ratio.

FIG. 18(*e*) is a drawing the mask pattern selected for each unit pixel, which corresponds to the region 8, based on the yellow density data shown in FIG. 18(*a*) and the mask selection pattern MP shown in FIG. 18(*b*). In this embodiment, the mask pattern A is used for a unit pixel, the mask selection parameter MP of which is 0, and the mask pattern B is used for a unit pixel, the mask selection parameter MP of which is 1. For the inks other than the yellow ink, the mask pattern A is used for all the unit pixels.

FIG. 18(*f*) is a drawing which shows the results of the product between the image data for yellow shown in FIG. 18(*a*), and the recording permission ratio shown in FIG. 18(*c*), which is obtained through the step 1703 or 1704.

FIG. 18(*g*) is a drawing which shows the results of the binarization of each unit pixel, in a format of (2 pixels×4 pixels). The black pixels are where the dots are to be recorded by the region 8, and the white pixels are where no dot is going to be recorded.

This embodiment described above is an adaptation of the recording method disclosed in Japanese Laid-open Patent Application 2000-103088. More specifically, disclosed in Japanese Laid-open Patent Application 2000-103088 is a recording head structure which uses nonbinary (multi-value) mask patterns, the recording permission ratio of which is as shown in FIG. 15, instead of the binary mask pattern which has been commonly used in the past. And, the pixels to be recorded during each recording pass (scan) is determined by the result of the binarization of the product of the multiplication between the nonbinary (multi-value) density data, and the recording permission ratio set by the mask pattern. With the employment of a method such as the above described one, even if the multiple recording passes are slightly different in the point of recording (registration), the resultant image will be significantly less nonuniformity in density, which results from this nonuniformity in the point of recording.

In this embodiment, not only the recording head structure disclosed in Japanese Laid-open Patent Application 2000-103088, but also, the recording head structure capable of changing the mask pattern to be used, for every unit pixel, are employed. Thus, not only does this embodiment provide the same effects as the first embodiment, but also, it provides the effects disclosed in the Japanese Laid-open Patent Application 2000-103088. In the case of the mask pattern shown in FIG. 16(*a*), all the recording passes (primary scans) are the same in recording permission ratio. However, all the recording passes (primary scans) do not need to be made equal in recording permission ratio. In essence, all that is required is that the mask pattern A is smaller than the mask pattern B, in terms of the recording permission ratio for the latter half of the recording passes (primary scans) or the last recording pass.

(Embodiment 3)

Also in this embodiment, the same ink jet recording apparatus shown in FIGS. 6-8, and the same ink, as those used in the above described embodiments, are used. As for the series of image processing steps used in this embodiment, it is roughly the same as that used in the second embodiment. In this embodiment, however, instead of the mask parameter MP in FIG. 10, the intermediary mask selection parameter MP'1104 in FIG. 10, that is, the mask selection parameter prior to the binarization process, is transferred to the recording apparatus. Thus, the recording apparatus in this embodiment receives the density datum 107, which is made up of eight bits per color of unit pixel, and the intermediary mask selection parameter MP'1104, which is made up of five bits, being there capable of having 32 different values, from the host apparatus.

FIG. 20 is a drawing for describing 32 different mask patterns 0-31 prepared in this embodiment. The mask pattern 0 in the drawing is the same as the mask pattern A in the second embodiment, and is 12.5% in recording permission ratio for all of the eight regions into which the nozzle column was divided. As for the mask pattern 31, it is the same as the mask pattern B in the second embodiment. That is, its recording permission ratio is set relatively low to 7.5% in recording permission ratio, for the upstream half (four regions) of the eight regions, in terms of the secondary scan direction, whereas it is set relatively high to 25%, for the downstream (four areas) in terms of the secondary scan direction. Further, the recording permission ratios of the mask patterns 1-30 are set to such values, one for one, that the intervals among their recording permission ratios are equally allotted. That is, the greater in the number the mask pattern, the higher the probability with which dots are recorded during the relatively late half of the recording passes. This kind of mask pattern (in second and this embodiments) is one-dimensionally structured, and therefore, is relatively small in the amount of data, compared to the two-dimensional mask pattern in the first embodiment described above. In other words, even if 32 kinds of mask patterns need to be stored as in this embodiment, they do not require a large area in the memory of the apparatus.

FIG. 21 is a drawing for describing each of the image processing steps which the system controller 301 of the recording apparatus in this embodiment carries out. In this embodiment, first, it is determined in Step 2101 whether or not the inputted 8-bit data 107 is a datum to be processed, that is, the datum for yellow color (ink). If it is determined that the inputted data 107 is for the colors other than yellow, Step 2104 is taken, in which an 8-bit datum 2105 is generated with the use of the mask pattern 0. In other words, for the data for the cyan, magenta, and black, the mask pattern A, which makes the multiple recording passes (scans) less nonuniform in recording permission ratio, is used.

On the other hand, if it is determined that the inputted datum is for yellow (ink), Step 2101 is taken, in which a mask pattern, which corresponds to the value of the mask selection parameter MP'1104 for the pertaining unit pixel, is selected from among 32 different mask patterns shown in FIG. 20. More concretely, if MP'=0, the mask pattern 0 is selected, whereas if MP'=1, the mask pattern 1 is selected. Further, if MP'=31, the mask pattern 31 is selected, and so on. Thereafter, Step 2103 is taken, in which an output datum 2105 is generated with the use of the selected mask pattern. It should be noted here that MP' is related to the ratio of the output datum 2105 for yellow (ink) to the output data for the colors other than yellow. That is, the smaller the ratio, the larger the MP'. Thus, the smaller the ratio, the higher the pattern in the recording permission ratio with which recording is made in yellow ink during the latter half of the recording passes (scans) or the last recording pass (scan).

Also in this embodiment, the output datum 2105 is obtained by the multiplication between the 8-bit image datum 107 for the pertaining unit pixel, and the recording permission ratio stored in the selected mask pattern. Thereafter, the binarization step 2106 is carried out to obtain the 1-bit recording datum 2107. That is, the pixel for which a dot is to be recorded per recording pass (scan) is determined.

As will be evident from the description given above, the series of image processing steps shown in FIG. 21 is repeatedly carried out per unit pixel, which is 600 dpi in resolution. That is, also in this embodiment, the mask pattern to be used can be switched for each unit pixel.

In this embodiment described above, the different mask patterns switchable for each unit pixel is prepared by a greater number than in the two embodiments described above. Therefore, this embodiment is more flexible than the preceding two embodiments, in terms of the response to the small changes in the density data. Thus, this embodiment can reduce the concern about image defects attributable to the switching between the two masks which are substantially different in recording permission ratio. Thus, it may be expected that the recording apparatus in this embodiment will output an image which is smoother in appearance than those which will be outputted by the recording apparatus in the preceding two embodiments.

(Embodiment 4)

In order to prevent the formation of an image which suffers from the nonuniformity in density, which is attributable to positional registration errors, the second and third embodiments, which adopted the structural arrangement disclosed in Japanese Laid-open Patent Application 2000-103088, binarized the nonbinary (multi-value) density datum after dividing the multiple data, which correspond one for one to multiple recording passes (scans) (which correspond to multiple nozzle groups; multiple regions of nozzle column). However, in case where the binarization process is carried out after the division of the density data into multiple data, there is no complementary positional relationship among the dots recorded during each recording scan, and therefore, there will be unit pixels into which no dot is recorded even if an image to be recorded is a 100% image, and/or unit pixels into which two or more dots are recorded in layers. Japanese Laid-open Patent Application 2000-103088 states that this kind of state is effective to suppress or minimize the density aberration attributable to the registering errors.

However, the employment of only the method described in Japanese Laid-open Patent Application 2000-103088 cannot provide the positional relationship between the dot recorded during one of the recording passes and the dot recorded during the other recording pass(s). Thus, it is likely to yield an image, the low frequency components of which are conspicuous. In other words, it is likely to yield a grainy image. In this embodiment, therefore, in order to ensure that a certain amount of complimentary positional relationship is maintained between a dot recorded during one of the multiple recording passes and a dot recorded during another recording pass, the information regarding the position of each of the recorded dot is obtained, and the position for the dots to be recorded during the following recording passes are selected so that the dots to be recorded will not be on the spot (unit pixel) on which the dot has already been recorded.

Also in this embodiment, the same ink jet recording apparatus, as those in the preceding embodiments, illustrated as in FIGS. 6-8, and the same inks as those in the preceding embodiments, are used. As for the series of image processing steps used in this embodiment, those carried out by the host apparatus is similar to that in the third embodiment, except for a small difference. That is, in this embodiment, the information regarding the dot positioning, which is obtained through the binarization step, is fed back to the nonbinary (multi-value) image data. Therefore, the unit pixel in this embodiment is 1,200 dpi×2,400 dpi in resolution, which is the same as the pixel resolution. That is, the recording apparatus in this embodiment receives from the host apparatus, the density datum 107, which is made up of 8-bit datum per unit pixel and is equivalent to 1,200 dpi×2,400 dpi in resolution, and the 5-bit mask selection parameter MP'1104 for each pixel.

FIG. 22 is a drawing for describing each of the image processing steps to be carried out by the system controller of the recording apparatus in this embodiment. In this embodiment, first, it is determined in Step 2201 whether or not the inputted 8-bit density data 107 is a datum for the colors other than yellow color (ink). If it is determined that the inputted datum 107 is for the colors other than yellow, Step 2204 is taken, in which an 8-bit datum 2205 is generated with the use of the mask pattern 0.

On the other hand, if it is determined in Step 2201 that the inputted datum is for yellow (ink), Step 2201 is taken, in which a mask pattern, which corresponds to the value of the mask selection parameter MP'1104 for the pertaining unit pixel, is selected from among 32 different mask patterns shown in FIG. 20. Thereafter, Step 2203 is taken, in which an output datum 2205 is generated with the use of the selected mask pattern. Up to this point, this embodiment is the same as the third embodiment described above.

In the following Step 2206, a new 8-bit CMYK information C", M", Y" and K" is obtained by processing the generated output datum 2205, based on the control information given in the next drawing, or FIG. 23. It should be noted here that the control information is the information for rectifying the output data 2205 for the (N+1)-th recording pass so that the probability with which a dot is recorded into the unit pixel which was selected as the unit pixel into which a dot is recorded during one of the first to N-th recording passes (scans) becomes lower. The new 8-bit information 2207 obtained through these steps is binarized with the use of the error diffusion method, dither matrix method, or the like method (Step 2208) to obtain 1-bit data 2209 for each color.

Next, a control information computation step 2210 for obtaining the control information for rectifying the output data 2205 for the following recording pass, is carried out, based on the obtained 1-bit recording datum 2209. Then, the obtained information is rewritten as new control information (Step 2211).

FIG. 23 is a diagram for describing the process for computing the control information and the process for rewriting the control information. Next, the control information computation process and control information rewriting process will be described with reference to FIGS. 23 and 22. Designated by a referential number 2302 is information which shows the position of the unit pixel into which a dot is recorded by a nozzle. In Step 2210, in which control information is computed, a nonbinary (multi-value) datum (255) is given to the unit pixel, the position of which is given by information 2302, and low pass filtering step 2305 is performed around this unit pixel to disperse the nonbinary (multi-value) data to the surrounding unit pixels. Then, this is converted into minus datum, and is temporarily stored. This minus datum bears the role of reducing the probability with which a dot is recorded into the unit pixel, into which another dot has been recorded during the N-th recording pass, during the (N+1)-th recording pass. Further, the 8-bit datum 2309 (2207) for the nozzle group (region) N is filtered in Step 2310, and the obtained datum is temporarily stored as a plus datum. This plus datum bears the role of the density of the output datum for the (N+1)-th recording pass (scan) is maintained even when the above described minus datum is made to reflect upon the output datum for the (N+1)-th recording scan. Thus, the sum of this plus datum and the above described minus datum is roughly zero. These minus and plus data are added to the control information for the first to (N−1)-th recording scan to obtain a new control information 2306. The thus obtained control information 2303 is a datum for rectifying the output datum for the (N+1)-th recording pass to reduce the probability with which a dot is recorded into the unit pixel, which has been determined as a unit pixel into which a dot will be recorded during one of the first to N-th recording scans.

Next, this new control information 2306 is added to (subtracted from) the output datum 2205 (2301) for the (N+1)-th recording scan. The result of the binarization (Step 2308) of the thus obtained new 8-bit datum becomes the information (recording datum 2209) which indicates the position of the unit pixel, into which a dot is to be recorded by the nozzle group (N+1) during the (N+1)-th recording scan. Further, the data for the other nozzle groups are also repeatedly processed as described above to obtain the final binary data (position of unit pixels into which dots are to be recorded).

In this embodiment, the control information is written over each time cumulative number of recording scans increases, and therefore, a unit pixel selected as the unit pixel into which a dot is to be recorded increases in minus value, whereas a unit pixel, which has not been selected as the unit pixel into which no dot is to be recorded is likely to increase in plus value. Thus, once a dot is recorded into a given unit pixel, the datum for this unit pixel, which is created for the next group of nozzles, is likely to become zero as it is binarized. That is, once a dot is recorded into a given unit pixel, this unit pixel becomes smaller in the probability with which a dot will be recorded into this unit pixel. Therefore, each recording scan is likely to be exclusionary to the other recording scans in terms of the dot arrangement, making it possible to obtain an image which is uniform in that it is low in the number of low frequency components, appearing therefore less grainy.

FIGS. 24(*a*)-24(*h*) are drawings of the examples of the density datum 107, intermediary mask selection parameters MP', mask patterns, and examples of recording data obtainable from the preceding variables. FIG. 24(*a*) is an example of the density data 107 for yellow, which is for a unit pixel made up of 4×4 pixels. The density level of each pixel is expressed in the form of a value in a density scale having 0-255 levels.

FIG. 24(*b*) is a drawing that shows an example of intermediary mask selection parameter MP' for each unit pixel, which are obtainable from the abovementioned density datum for yellow, and the unshown density data for other three colors.

FIG. 24(*c*) shows several mask patterns among the mask patterns 0-31 in FIG. 20, which correspond to the region 1 (nozzle group 1) of the nozzle column. The recording permission ratio for the mask pattern 0 is 12.5%, whereas that for the mask pattern 31 is 7.5%.

FIG. 24(*d*) is a drawing which shows the selected mask patterns for the unit pixels which correspond to the region 1, and which correspond to the yellow density data shown in FIG. 24(*a*). In this embodiment, the mask pattern 0 is used for the unit pixel for yellow, the intermediary mask selection parameter MP' of which is 0 (MP'=0), and all the unit pixels for black, cyan, and magenta. Further, for the unit pixel for yellow, the intermediary mask selection parameter MP' of which is not 0 (MP'≠0), a mask pattern which corresponds to the value of MP', is used.

FIG. 24(*e*) is a drawing which shows the products of the multiplication between the density data for yellow, which is shown in FIG. 24(*a*), and the recording permission ratio shown in FIG. 24(*d*), which is obtained by Step 2203 or Step 2204.

FIG. 24(*f*) is a drawing which shows the results of the binarization of each value in FIG. 24(*e*). The black pixel in FIG. 24(*f*) is a pixel in which a dot is recorded by the region 1 of the nozzle column, and the white pixels are the pixels in which a dot is not recorded.

FIG. 24(*g*) is a drawing which shows the results of the dispersion of the multi-value data into the pixels around the black pixel shown in FIG. 23(*f*), by low-pass filtering (Step 2305), for the control information computation carried out in Step 2210. FIG. 24(*h*) shows the sum of the density data for the region 1, shown in FIG. 24(*e*), and the minus information in FIG. 24(*g*). Thus, the control information can be generated while retaining the density as described above. Incidentally, here, the filtering process (Step 2310) is not carried out.

FIG. 24(*i*) is a drawing which shows the result of the addition of the control information given in FIG. 24(*h*) to the result of the multiplication between the density data and the recording permission ratio set by the mask pattern, for the region 2. Referring again to FIG. 20, in this embodiment, the mask data (recording permission ratio) for the region 1, and that for the region 2, are equal in value regardless of the mask pattern. Thus, the result of the product, for the region 2, between the image data and the recording permission ratio determined by the mask pattern, is as shown in FIG. 24(*e*), as is the result for the region 1.

As will be evident from FIG. 24(*i*), the image datum for the pixel in which a dot is recorded by the region 1, and the image datum for the pixels immediately adjacent to the pixel in which a dot is recorded by the region 1, are smaller in value than the image data for the pixels which are farther away from the pixel in which a dot is to be recorded by the region 1, than the image datum for the pixel immediately next to the pixel in which a dot is to be recorded by the region 1. Thus, the probability with which a dot is recorded by the region 2 into the pixel by the region 1, and the immediate adjacent pixels, remains extremely small, even if the data is binarized with the use of the error diffusion or dithering.

In this embodiment, the probability with which two or more dots are recording in layers during the multiple recording scans is minimized by the above described structural arrangement, in addition to that in the third embodiment. Thus, not only does this embodiment provide the effects provided by the above described third embodiment, but also, can yield an image which is not only smaller in the amount of low frequency components, but also, does not suffer from the nonuniformity in density, which is attributable to the misalignment in recording position among the multiple recording scans.

(Embodiment 5)

Also in this embodiment, the same ink jet recording apparatus as that used in the first embodiment, that is, the ink jet recording apparatus shown in FIGS. 6-8, and the same inks as those used in the first embodiment, will be used. Further, as for the series of image processing steps, the image processing steps carried out by the host apparatus are roughly the same as those in the first embodiment, which were described with reference to FIG. 10. In this embodiment, however, the intermediary mask selection parameter MP' is not computed from the CMYK density data obtained after color separation. Instead, it is calculated from the RGB data 101 obtained after the resolution conversion. Thus, this embodiment is characterized in that the recording permission ratio for a specific ink (yellow) is variably set for each of the multiple recording scans, based on the RGB information.

FIG. 26 is a flowchart for describing the image processing steps carried out by the host apparatus in this embodiment. In the intermediary mask parameter MP' setting steps in this embodiment, the intermediary mask selection parameter MP' 2602 is not set based on the 8-bit density data for CMYK generated by the color separation step 106. Instead, it is set based on the RGB data 101 obtained after the resolution conversion.

The intermediary mask selection parameter MP' may be calculated with the use of a preset mathematical formula, as it is in Step 1103 described during the description of the first embodiment. Generally speaking, there is no linear relationship between the RGB data and CMYK data, and therefore, it is impossible to find such a proper mathematical formula that can unconditionally calculate the intermediary mask selection parameter MP'. Therefore, it is desirable that a three dimensional LUT, such as Table 6, in which the intermediary mask selection pattern MP' is defined in advance in each cell of the three dimensional data for RGB, is provided so that a proper intermediary mask selection parameter MP' is selected for each unit pixel.

TABLE 6

| R | G | B | MP' |
|---|---|---|---|
| 0 | 0 | 0 | 2 |
| 0 | 0 | 17 | 10 |
| 0 | 0 | 34 | 20 |
| 0 | 0 | 51 | 24 |
| . | . | . | . |
| . | . | . | . |
| . | . | . | . |
| 119 | 119 | 0 | 0 |
| 119 | 119 | 17 | 5 |
| 119 | 119 | 34 | 10 |
| . | . | . | . |
| . | . | . | . |
| . | . | . | . |
| 255 | 255 | 221 | 0 |
| 255 | 255 | 238 | 0 |
| 255 | 255 | 255 | 0 |

After the intermediary mask selection parameter MP' is set as described above, it is binarized (Step 2603) to obtain the 1-bit mask selection parameter 2604, which is transmitted to the recording apparatus. Thereafter, the mask patterns are selected in the recording apparatus, following the flowchart in FIG. 13, as in the first embodiment. By following the above described steps, it is possible to variably set the recording permission ratio for the special ink, for each of the multiple recording scans.

(Miscellaneous Embodiments)

In the five embodiments described above, the present invention was described with reference to the recording method which applies yellow ink later than the other inks, based on the fact that yellow ink is superior in friction resistance than the other inks. However, in a case where there is an ink which is superior in friction resistance than yellow ink, the same effects as those obtained by the preceding embodiments can be obtained by converting the signal value of this ink in the same manner as the above described datum for the yellow ink is converted. Further, in a case where there is an ink (of a color) which is inferior in friction resistance than the other inks (of other colors), the above described recording method can be used to apply this specific ink earlier than the other inks while defining this ink as the specific ink.

For example, a case in which an ink which is lighter in color than ordinary inks is prepared; an ingredient or ingredients, such as wax, which can yield an image superior in friction resistance, are mixed into the prepared ink; and the order in which this ink is applied is controlled, instead of the order in which yellow ink is applied, falls within the scope of the present invention. In this case, the ink of the lighter color falls under the definition of "special ink".

Further, in a case of an embodiment of the present invention, in which a clear ink, that is, an ink which does not contain coloring agent, and this clear ink is most friction resistant, the clear ink falls under the definition of "specific ink". In other words, a "specific ink" may be a transparent ink. Thus, an embodiment of the present invention, in which the specific ink is a transparent ink, also falls within the scope of the present invention.

Further, the number of the "specific inks" does not need to be limited to one. For example, in a case where four different inks, such as the CMYK inks in the above described embodiments, are used, two inks, for example, C and Y inks, may be designated as "specific inks", and the other inks, that is, M and K inks, may be designated as the "nonspecific inks". In this case, each ink may be made different from the other inks in the method for calculating the mask selection parameter, or the same parameter may be shared by all the inks. Further, each method for calculating the mask selection parameter may be varied. For example, if it is desired to switch the mask pattern according to the color combination between the specific two inks, the mask selection parameter may be calculated using only the data for the two colors, instead of taking into consideration the density data for all the colors as in the computation step 1103 in FIG. 10.

In all the embodiments of the present invention described above, multiple mask patterns are prepared for only the specific ink which an operator wants to control in the application timing, and the nonspecific inks were made the same in mask pattern. Needless to say, however, various mask patterns may be prepared in advance so that each ink is provided with a mask pattern different from those for the other inks.

Also in the above described embodiments, when selecting the parameter (mask pattern) to set the recording permission ratio for each of the recording scan for the specific ink (yellow), the information regarding all of the nonspecific inks to be applied to each unit pixel is taken into consideration. However, the datum (data) to be taken into consideration may be the information regarding only a part (for example, C) or parts (for example, M and K) of the nonspecific inks. That is, the present invention may be embodied in such a form that only the nonspecific inks (for example, M and K inks) which are involved in the determination of the recording permission ratio for the specific ink (Y), but also, a nonspecific ink (for example, C) which is not involved in the determination of the recording permission ratio with which the specific ink (Y) is applied. As will be evident from the description of the present invention given above, the essence of the present invention is that the ratio with which a specific ink is applied to each unit pixel is determined based on the information regarding the specific ink applied to each unit pixel and the information regarding to the nonspecific inks to be applied to the unit pixel, after the completion of the preceding recording scan.

Also in the embodiments of the present invention described above, the described control was carried out because the yellow ink was superior in friction resistance. However, the friction resistance of an ink is affected by other factors, for example, the type of the recording medium. Therefore, the nonuniformity in the frequency with which each nozzle is used can be reduced more by preparing two or more recording modes, and using the above described method only when the recording apparatus is operated in the mode in which friction resistance is the main concern.

As described above, according to the present invention, it is possible to control the order in which a specific ink is applied to each unit pixel, to which the specific ink is to be applied, without making each nozzle significantly different from the other nozzles in terms of the frequency of usage. Thus, the present invention enables the multi-pass recording method to fully display its effect, making it possible to output a high quality image which is uniform in appearance, and also, excellent in terms of friction resistance.

However, the property for determining whether an ink is a specific ink or a nonspecific ink does not need to be frictional resistance. The above described control structure in this embodiment effectively functions as long as it is employed by a recording apparatus which is structured so that it outputs an image which reflects the effect of applying a specific ink later (or earlier) than the nonspecific ink(s). For example, the present invention is applicable, with preferable results, to a case where the order in which color inks are applied is controlled to aggressively widen the color range.

FIG. 25 is a chromaticity diagram for describing the concrete example used when expanding the color range. The area surrounded by a solid line is the area obtained by projecting the color range, which is obtained by actually recording all the colors expressible by the host apparatus with the use of a recording apparatus W8400 (product of Canon), and projecting the color range obtained by measuring the recorded colors, onto a* b* plane. The recording medium used when obtaining this data is glossy photographic thin paper (product of Canon). This chromaticity diagram is obtained from an image recorded with the use of an ordinary recording method, that is, such a multi-pass recording method that the recording permission ratio for all colors is evenly dispersed among multiple recording scans. Referring to the diagram, designated by a referential symbol 14*a* is the position of a red color having strong yellow tint. In comparison, the point 14*a* can be moved to point 14*b* by controlling the recording apparatus in the opposite manner, that is, controlling the recording apparatus so that the yellow ink is applied ahead of the other inks. By controlling the recording apparatus in the opposite manner in terms of ink application order, it is possible to record red color which is stronger in yellow tint. In other words, by controlling the recording apparatus in the opposite manner, it is possible to expand the reproducible color range. Here, red color which is strong in yellow tint was used as an example. However, controlling not only the order in which inks are applied to generate a color at the fringe of the color range, but also, the order in which inks are applied to generate all the color in the color range, can further expand the color range.

Also in the above described embodiments, all the nozzle columns were divided into 8 regions (N=8).

That is, they were described with reference to an example of multi-pass recording method, the number of passes was 8 (N=8). However, the present invention can be embodied regardless of the value of N. Further, as for the direction in which the recording head is moved, it may be only one direction, or both directions. That is, the effects of the present invention remain roughly the same whether the recording head is moved in only one direction or both directions.

Further, the preceding embodiments were described as an ink jet recording system made up the host apparatus and recording apparatus, with reference to FIG. 7 (block diagram of system). However, the application of the present invention is not limited to the ink jet recording system, such as those in the preceding embodiments. Further, regarding the series of processing steps described with reference to various flowcharts, the apparatuses by which these series are carried out do not need to be limited to the host apparatus or recording apparatus. That is, the present invention is as effective as those embodiments described above, even if it is embodied so that all the processing steps are carried out in the host apparatus, and then, binary data, which control whether a dot is to be recorded or not, are inputted into the recording apparatus, or so that the recording apparatus itself directly receives the RGB data as they are, and carries out the series of image processing steps in the recording apparatus.

Further, in the above described embodiments, the recording permission ratio is set by the selection of the mask pattern. However, the method for setting the recording permission ratio does not need to be limited to this method. For example, the present invention may be embodied as follows: A default recording permission ratio is prepared for all the unit pixels, and the recording permission ratio is changed only for a unit pixels identified as the pixel to be changed in recording permission ratio, based on the information regarding the ink to be applied to the unit pixel. In this case, therefore, the means for identifying a unit pixel to be changed in recording permission ratio may be a means for selecting the value for the recording permission ratio, or a means for changing the recording permission ratio in value.

Further, the present invention can be embodied by a set of program codes for making the host apparatus and/or recording apparatus carry out the above described processes (processes for determining recording scan for applying specific ink(s)) which characterize the present invention, or a storage medium in which the set of program codes is stored. In this case, the above described processes are read and carried out by the computer (or CPU or MPU). As will be evident from the description of the present invention given above, the programs for making a computer perform the above described processes which characterize the present invention, or the storage medium in which the programs are stored, are also included in the scope of the present invention. As the storage media for supplying the program codes, a floppy (registered commercial name) disk, a hard disk, an optical disk, a photomagnetic disk, a CD-ROM, a CD-R, a magnetic tape, a nonvolatile memory card, a ROM, etc., can be used, for example. Further, the present invention may be embodied in such a form that as the sets of program codes read by a computer are carried out, the processes in the above described embodiments are carried out in entirety, or that the processes are partly or entirely carried out by the OS, which is in operation in the computer, based on the instructions of the program codes.

BRIEF DESCRIPTION OF THE DRAWINGS

FIG. 19 is a schematic drawing for describing the index development process.

FIG. 20 is drawing for describing the 32 mask patterns 0-31 applicable to the third embodiment.

Figure 1:
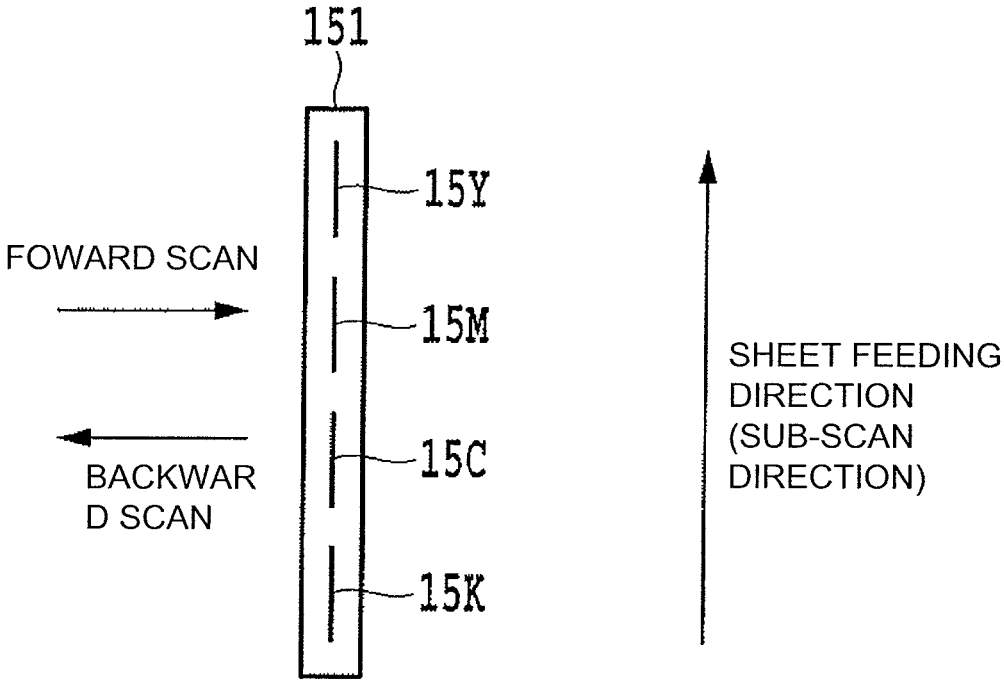
FIG. 1 is a schematic drawing for describing the recording head structured so that its nozzle columns are aligned in a single line which is perpendicular to the direction in which the recording head is moved for recording.
Figure 2:
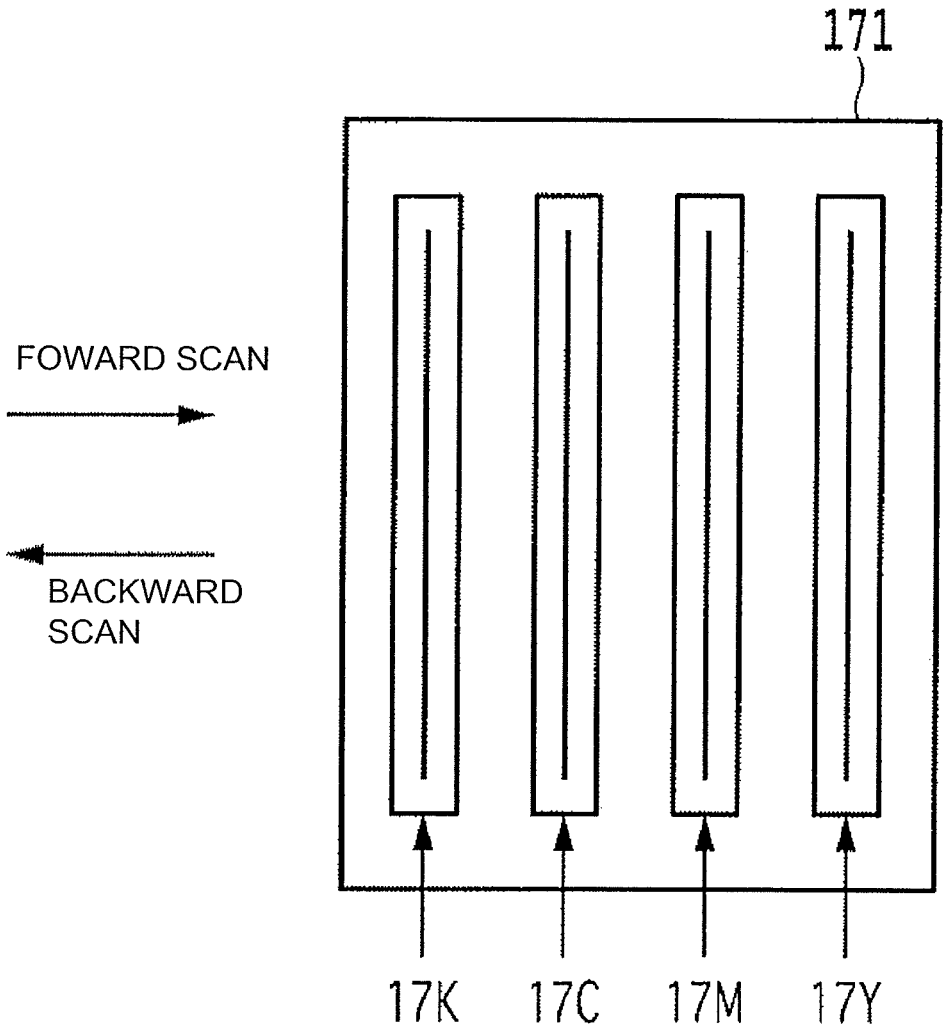
FIG. 2 is a schematic drawing for describing the recording head structured so that its nozzle columns are arranged in parallel and in tandem in the direction in which the recording head is moved for recording.
Figure 3:
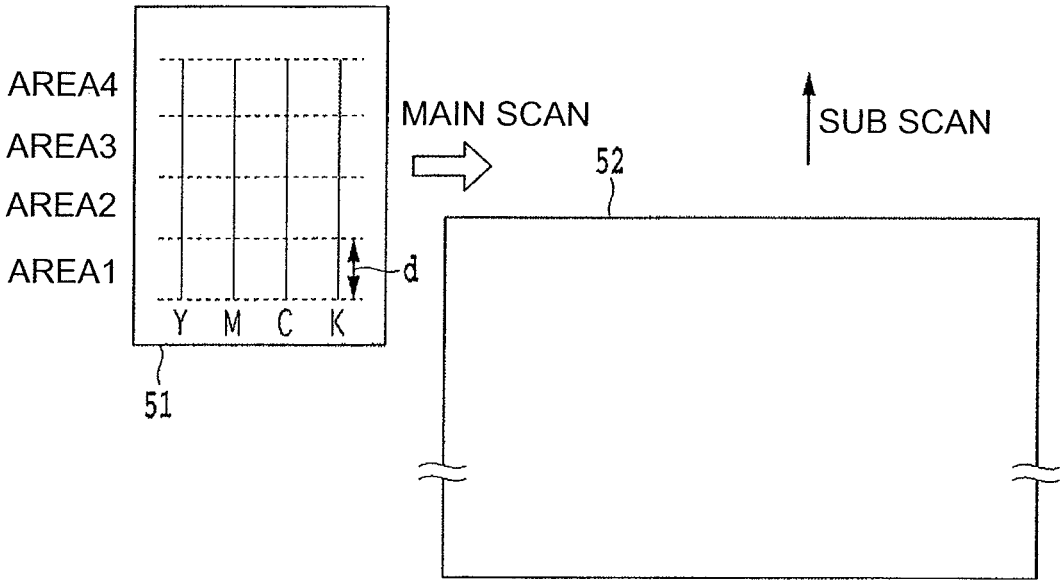
FIG. 3 is a schematic drawing for simply describing the multi-pass recording method.
Figure 4:
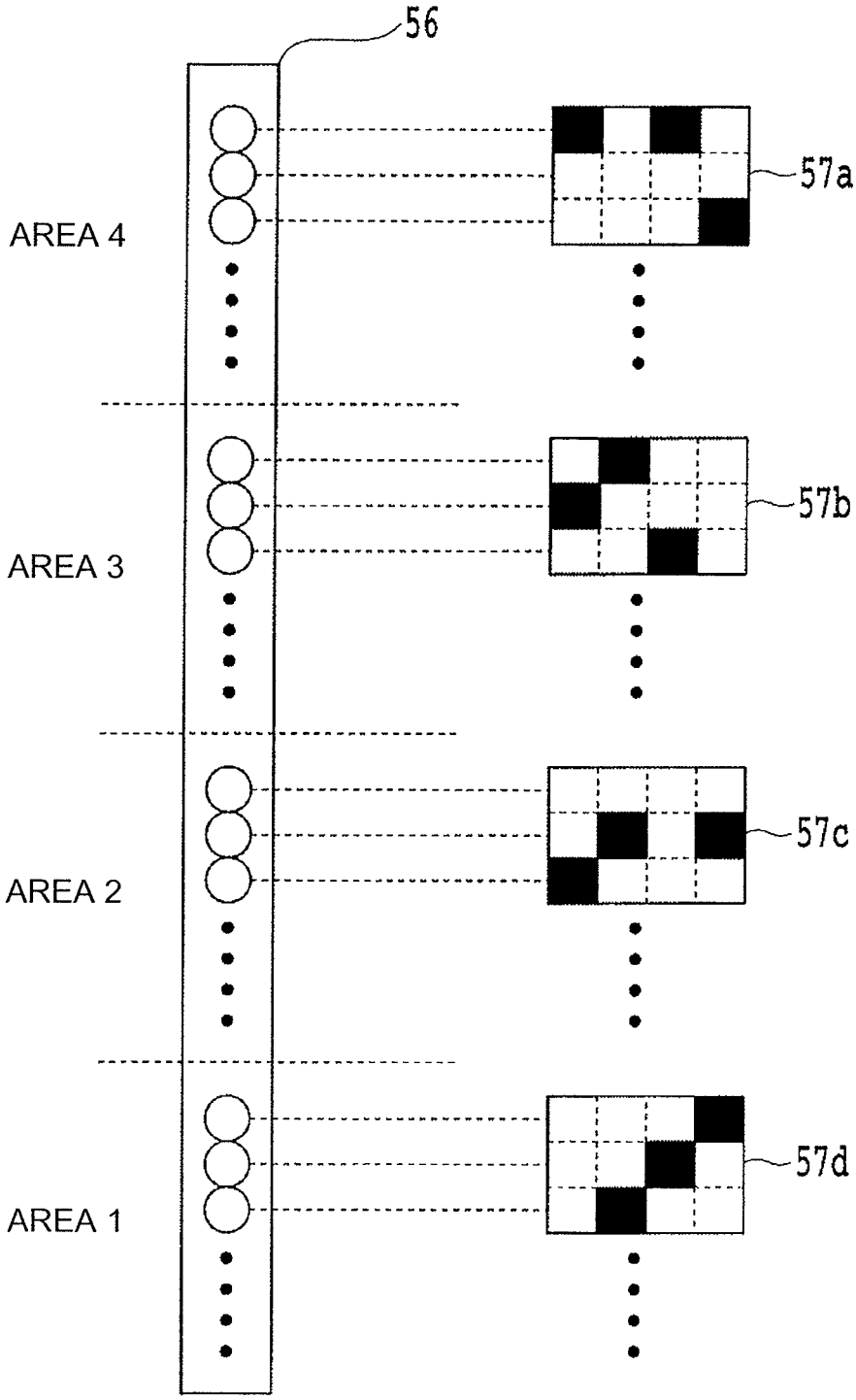
FIG. 4 is a drawing of examples of the mask pattern used for the multi-pass recording method.
Figure 5:
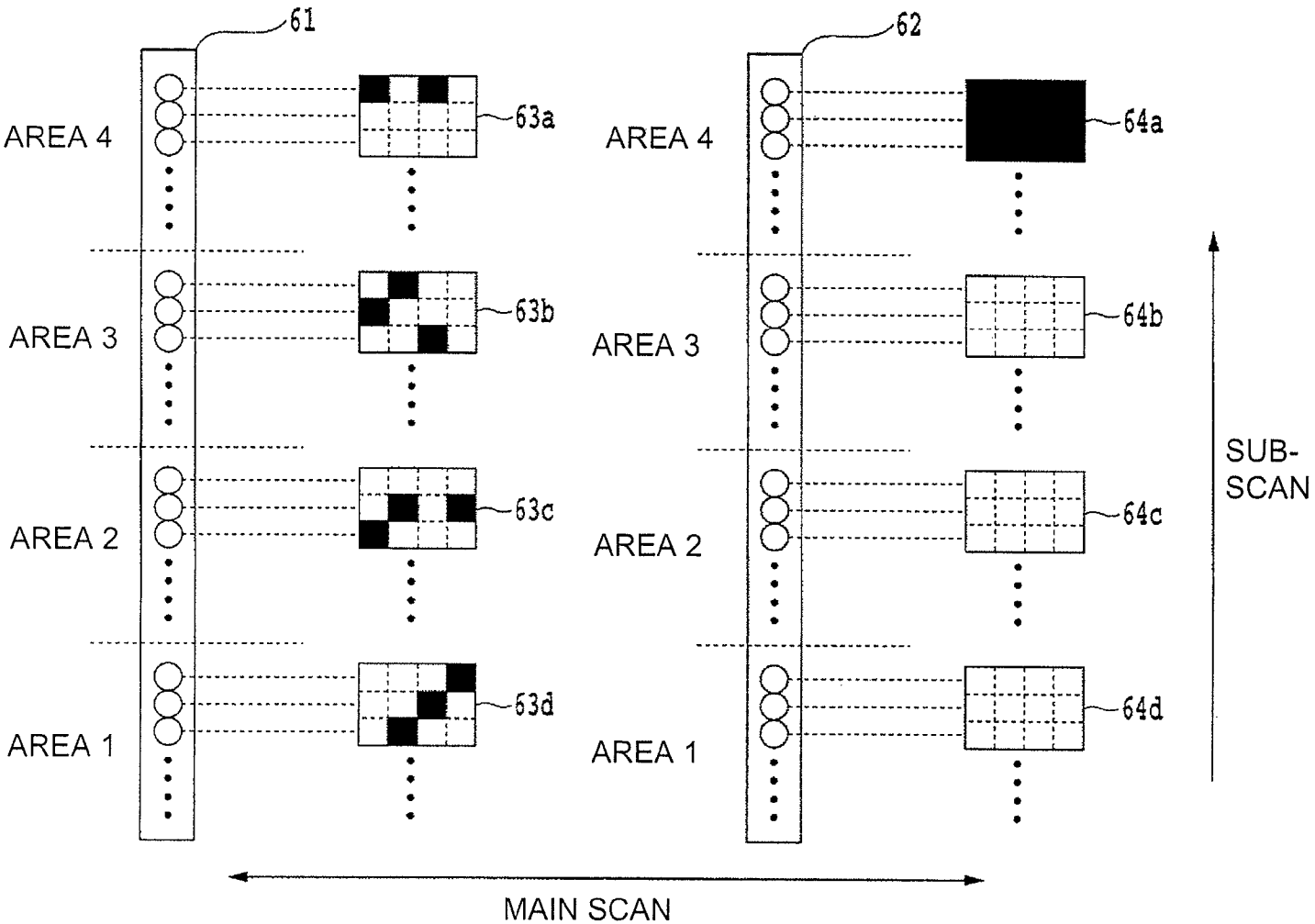
FIG. 5 is a drawing of examples of the mask pattern devised so that only yellow ink is applied to recording medium as late as possible compared to the other inks.
Figure 6:
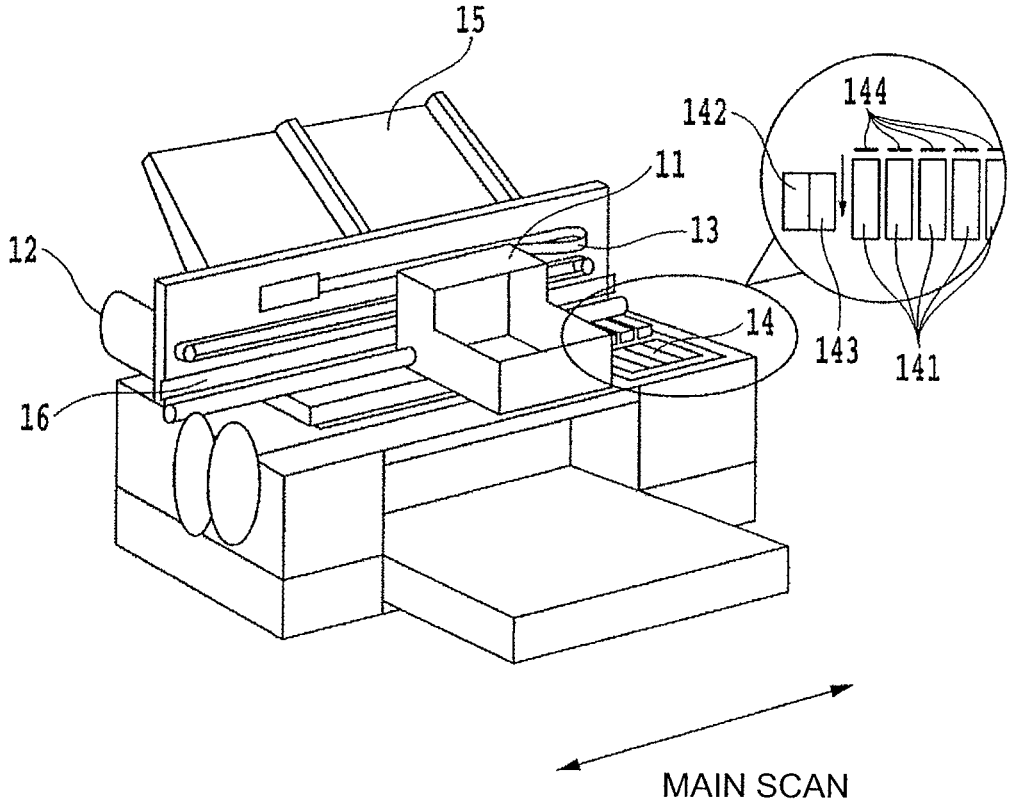
FIG. 6 is a drawing for describing the ink jet recording apparatus in terms of general appearance and structure.
Figure 7:
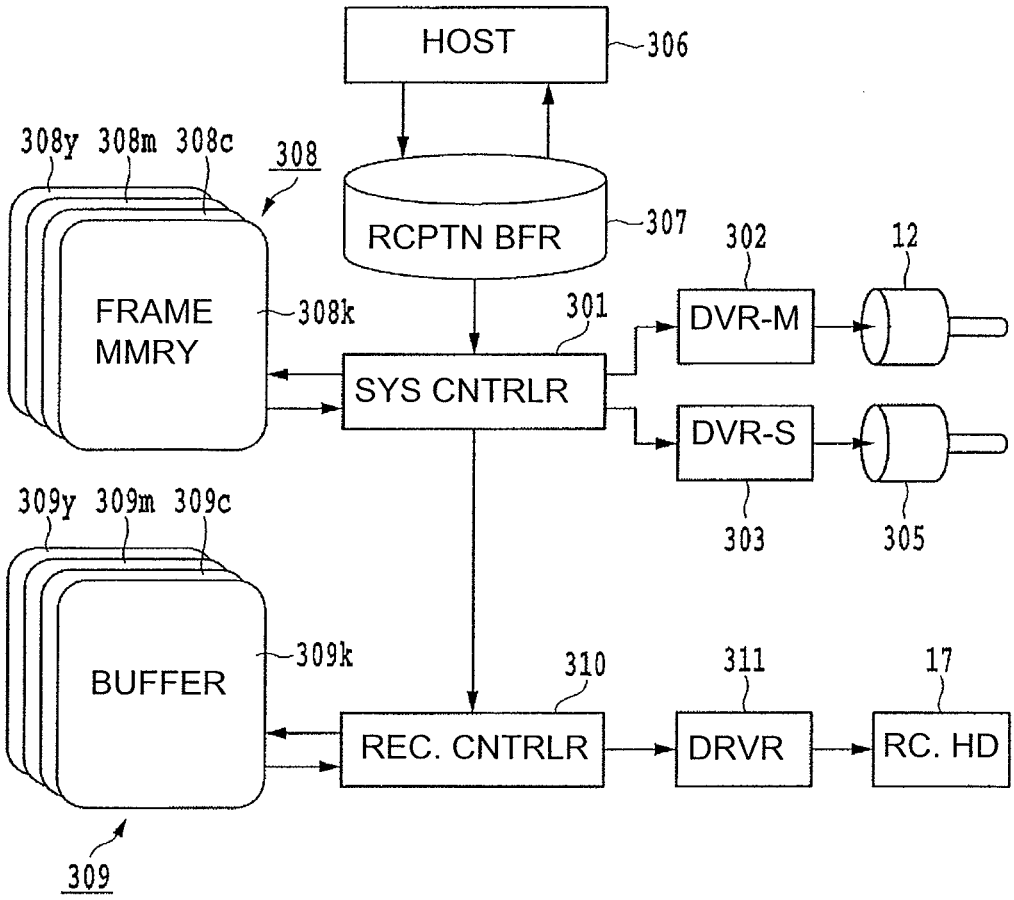
FIG. 7 is a block diagram for describing the structure of the control system of the ink jet recording apparatus.
Figure 8:
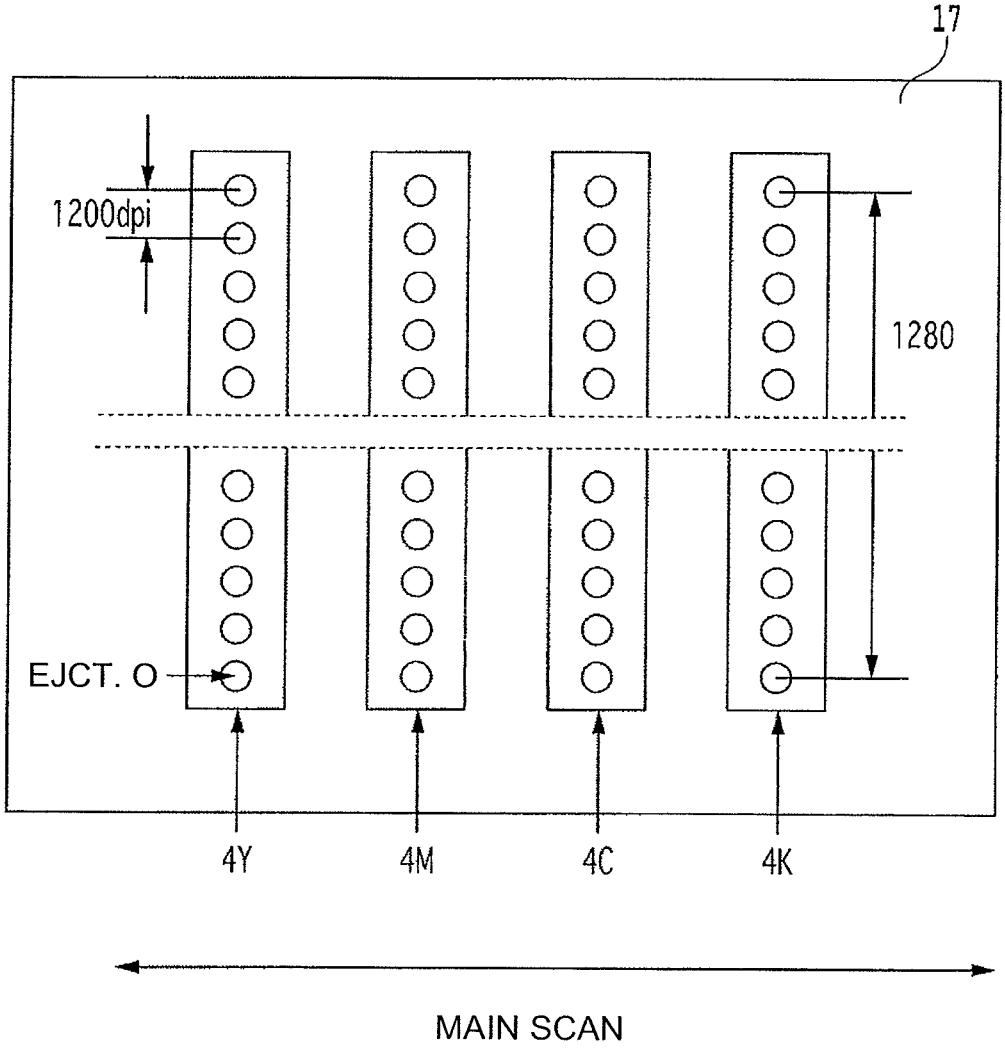
FIG. 8 is a schematic drawing of the recording head, as observed from the side toward which its nozzles are open.
Figure 9:
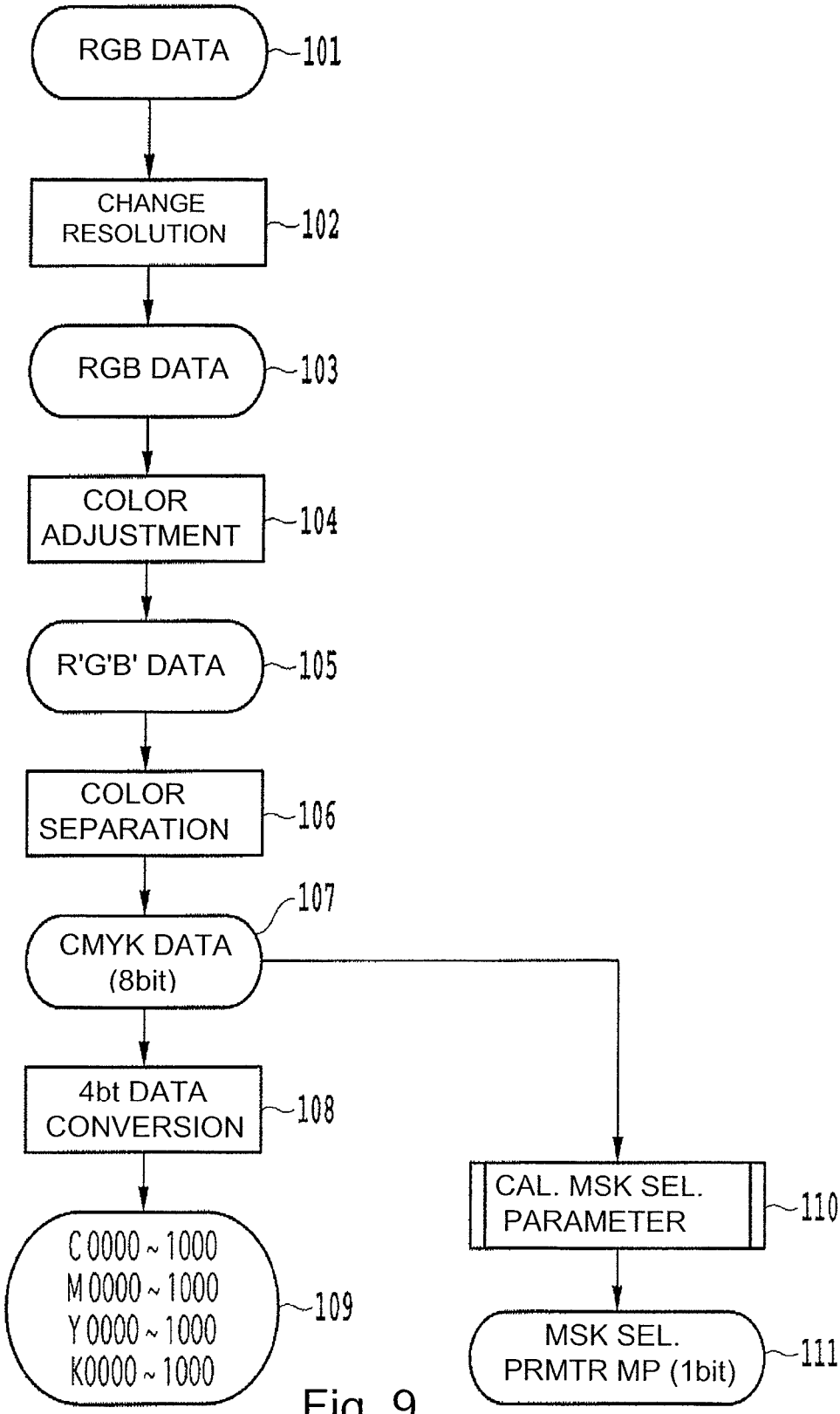
FIG. 9 is a flowchart for describing the image processing steps carried out by the host apparatus.
Figure 10:
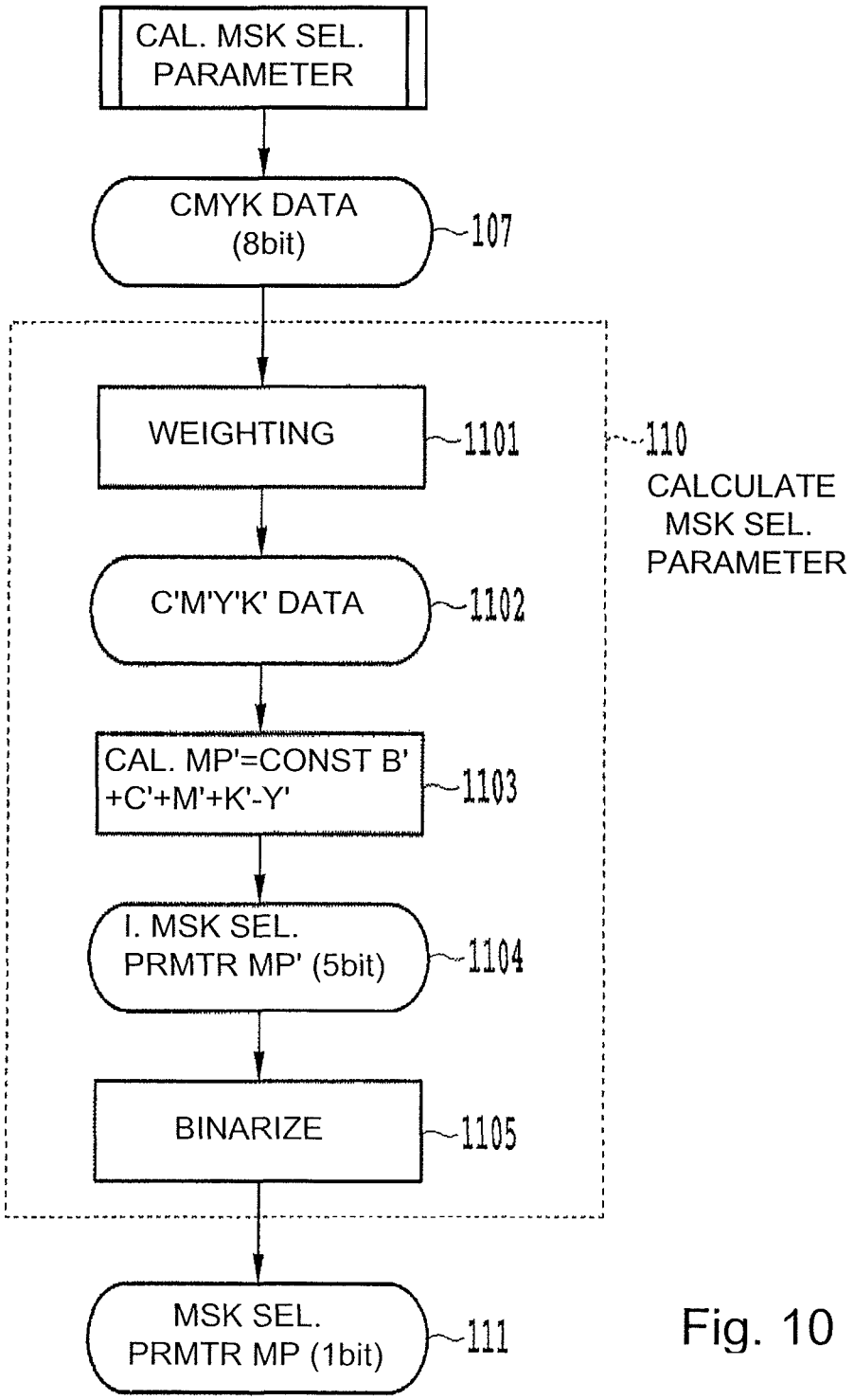
FIG. 10 is a flowchart for describing the computing processing steps for selecting the mask selection parameter.
Figure 11:
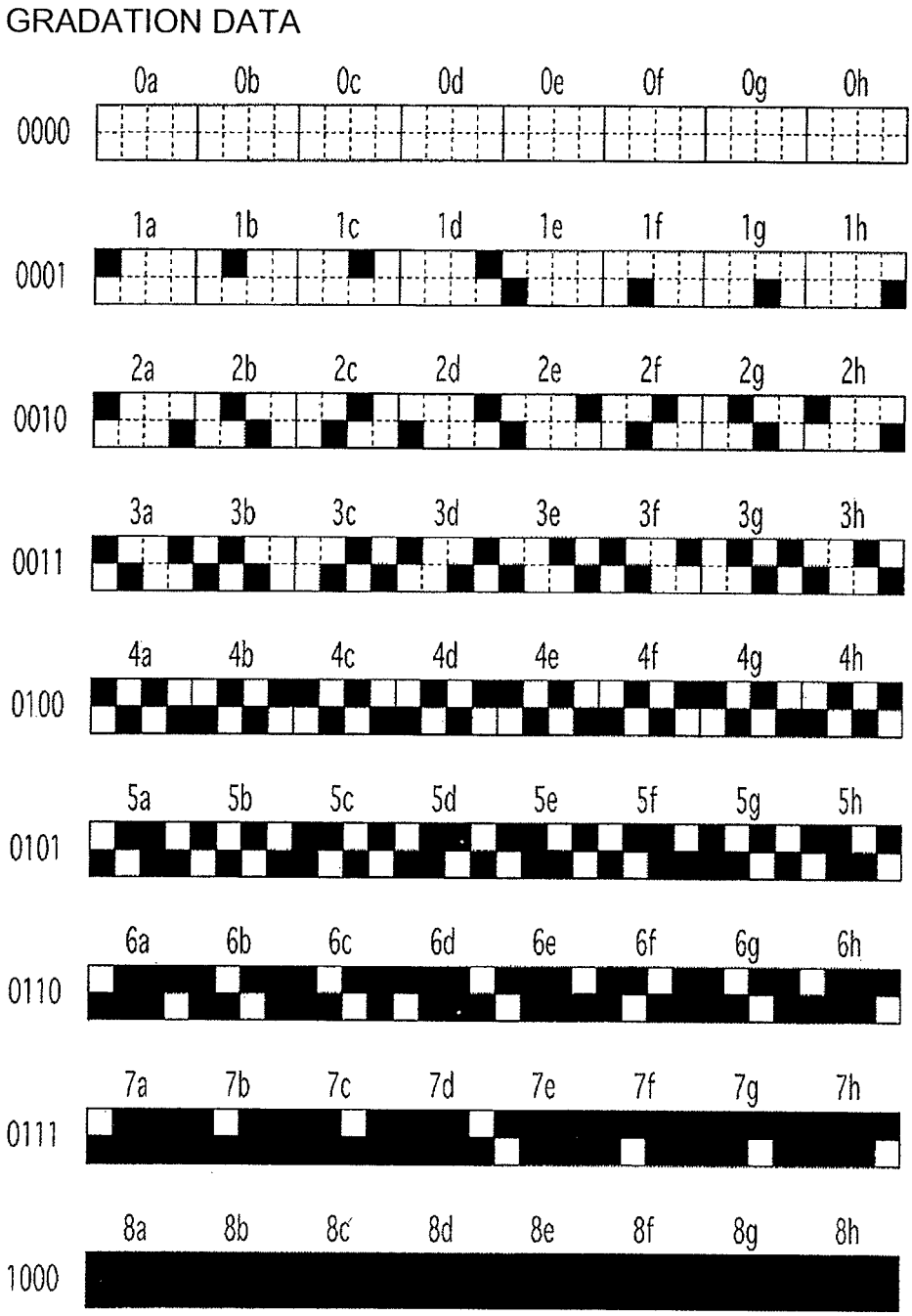
FIG. 11 is a schematic drawing for describing the index pattern (dot placement pattern) usable in the first embodiment.
Figure 12:
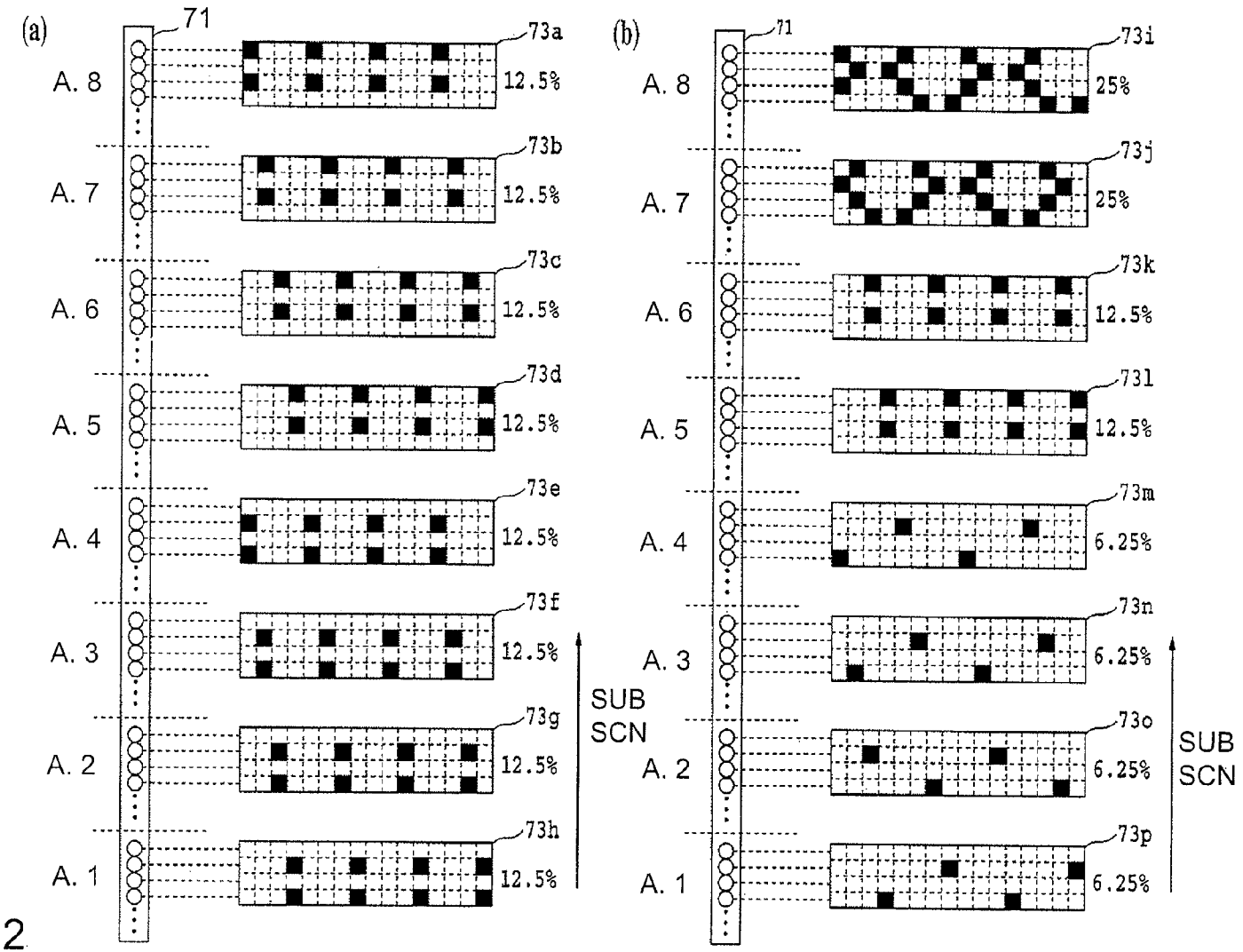
FIG. 12(*a*) is a schematic drawing which shows the mask pattern A applicable to the first embodiment, and FIG. 12(*b*) is a schematic drawing which shows the mask pattern B applicable to the first embodiment.
Figure 13:
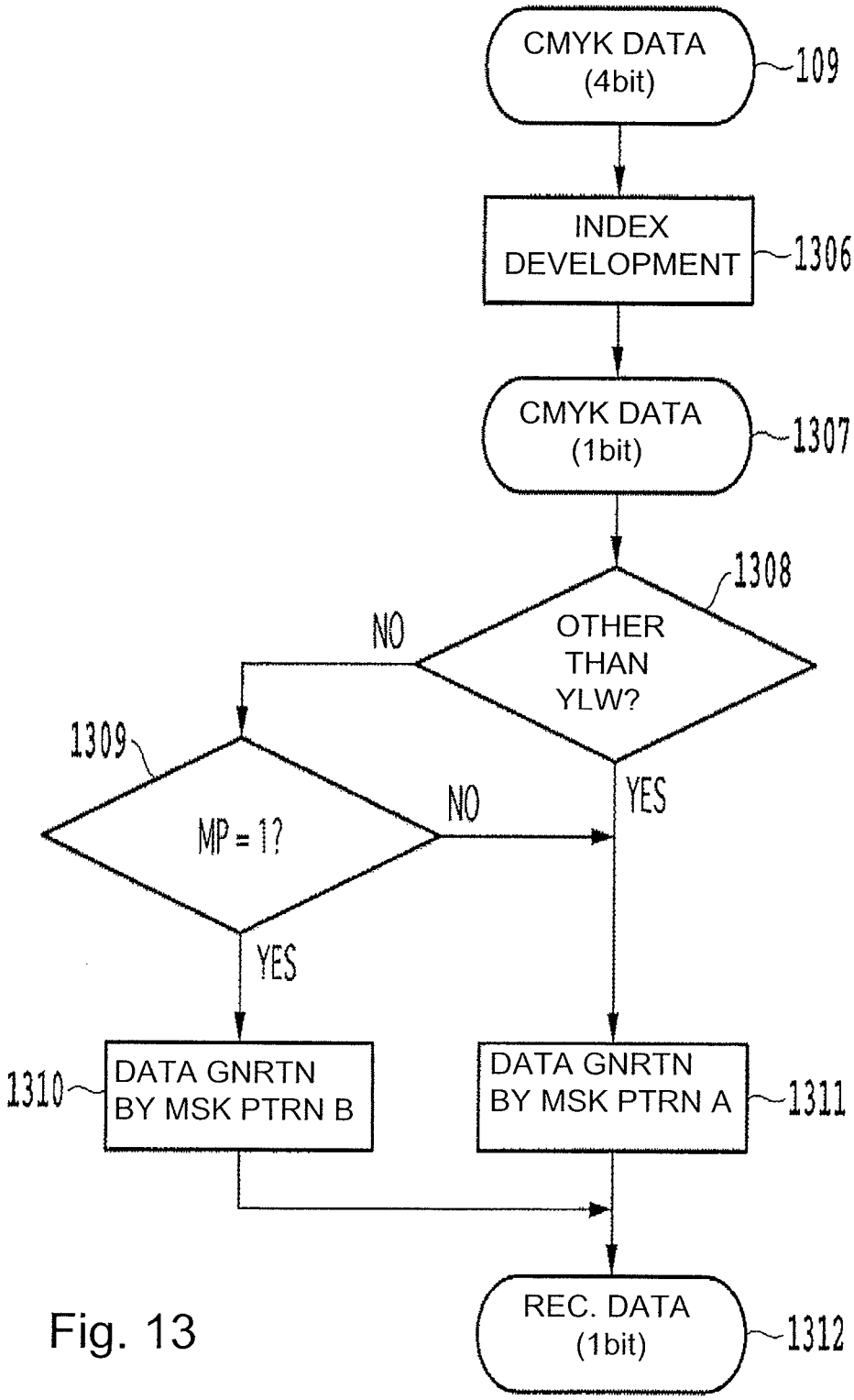
FIG. 13 is a flowchart for describing the image processing steps carried out by the system controller of the recording apparatus in the first embodiment.
Figure 14:
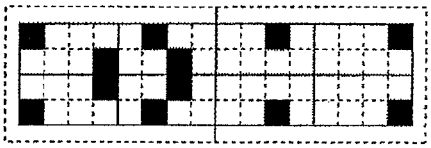
FIG. 14 is a drawing for describing the image data, mask selection parameter, mask pattern, and the recording data obtainable from the preceding variables.
Figure 14:
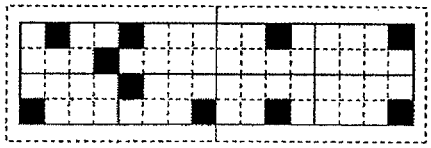
Figure 14:
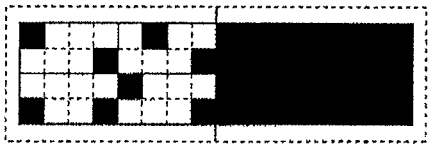
Figure 14:
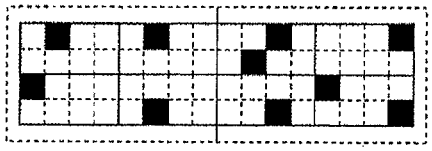
Figure 14:
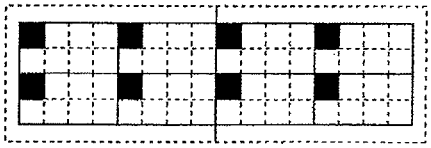
Figure 14:
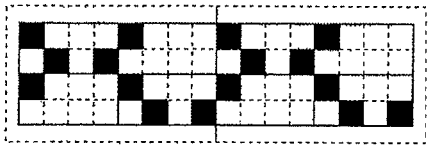
Figure 14:
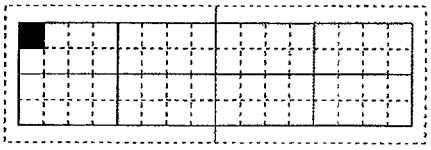
Figure 14:
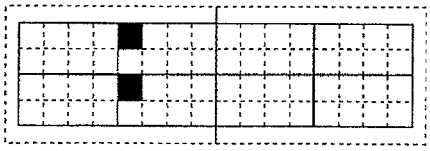
Figure 14:
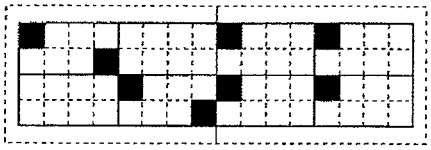
Figure 14:
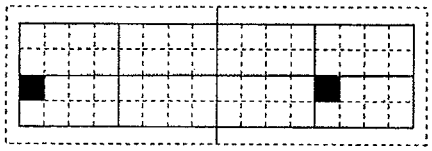
Figure 15:
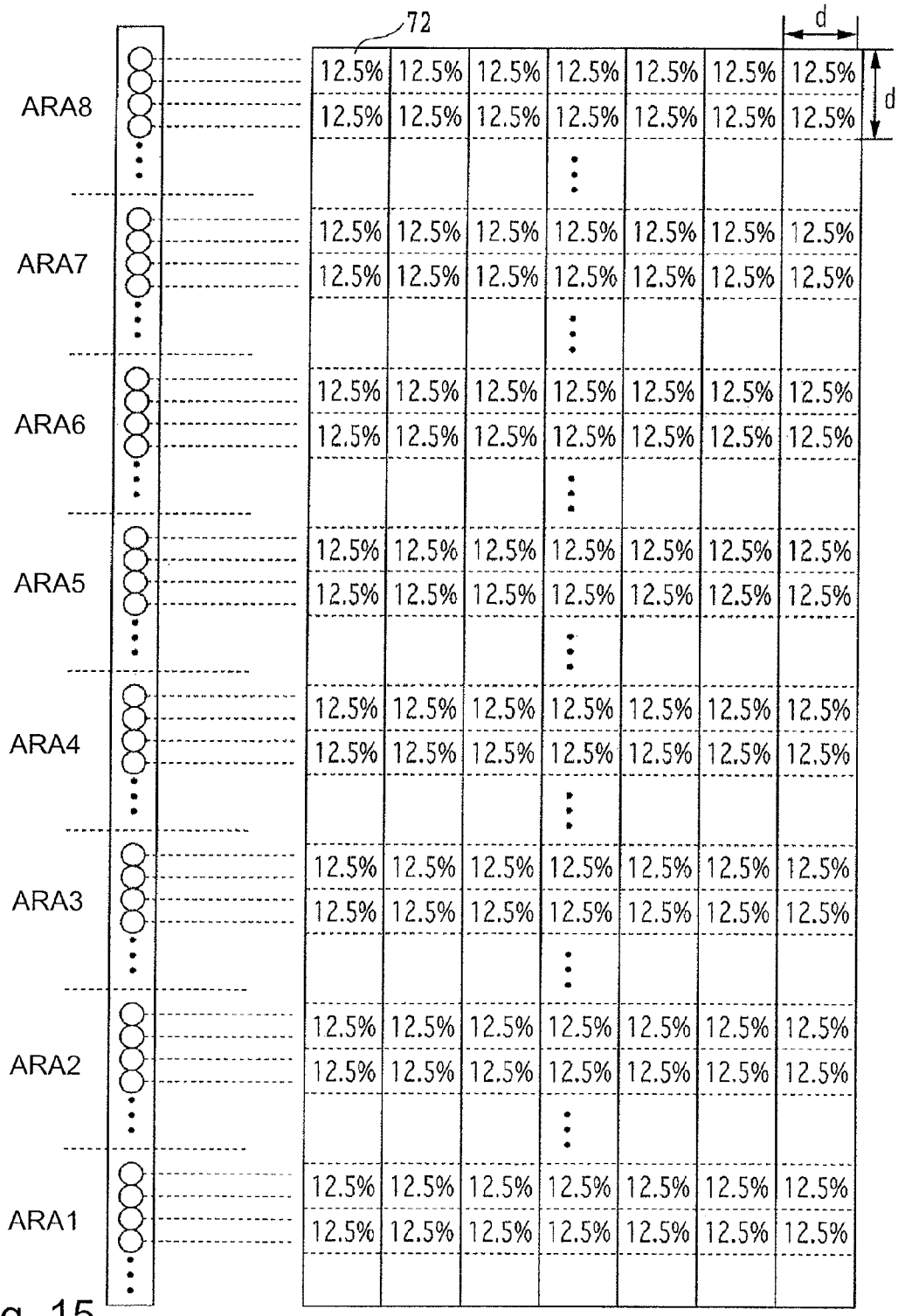
FIG. 15 is a schematic drawing for describing the structure of the mask pattern in the second embodiment.
Figure 16:
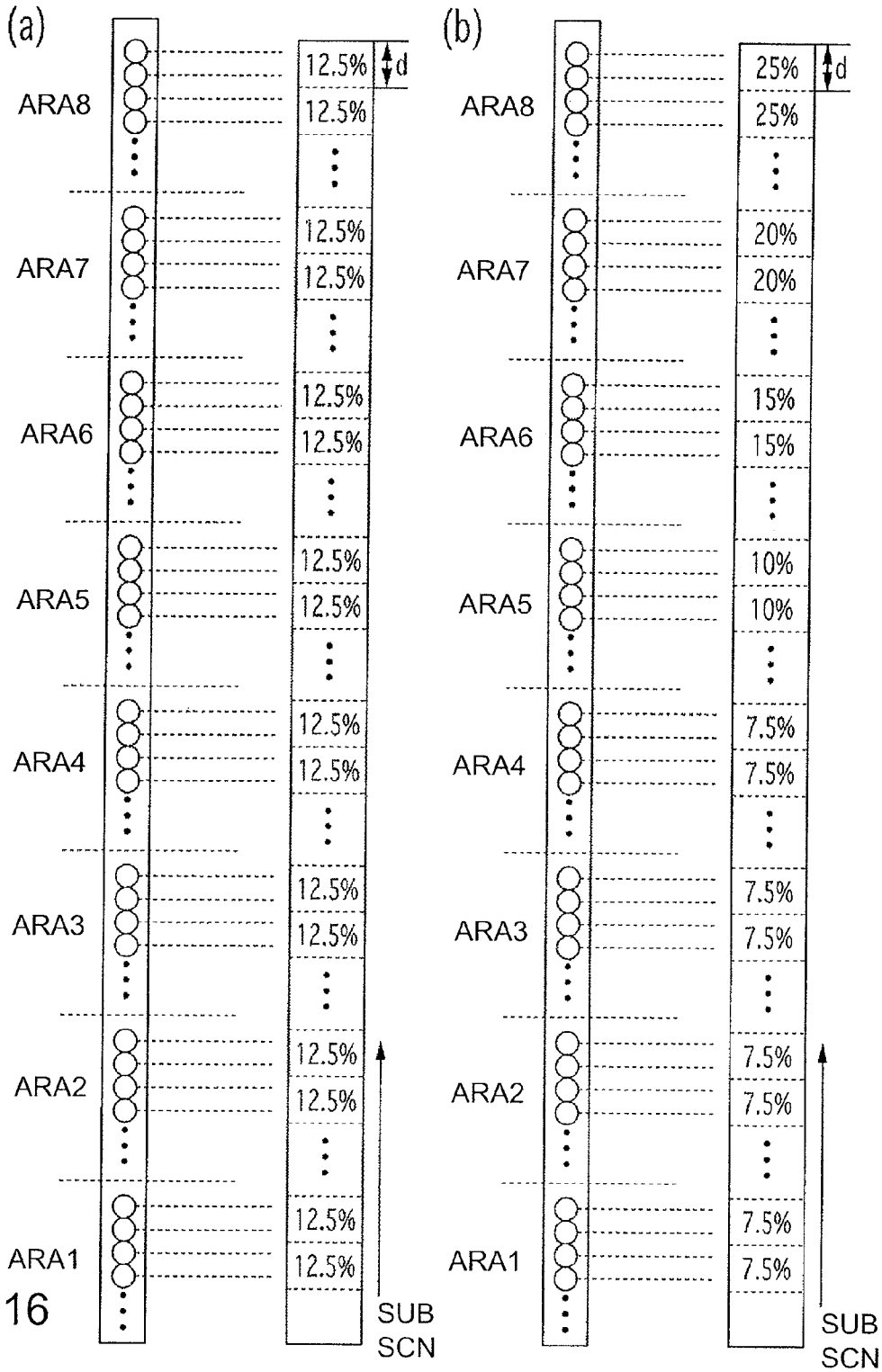
FIG. 16(*a*) is a schematic drawing of the mask pattern A applicable to the second embodiment, and FIG. 16(*b*) is a schematic drawing of the mask pattern B applicable to the second embodiment.
Figure 17:
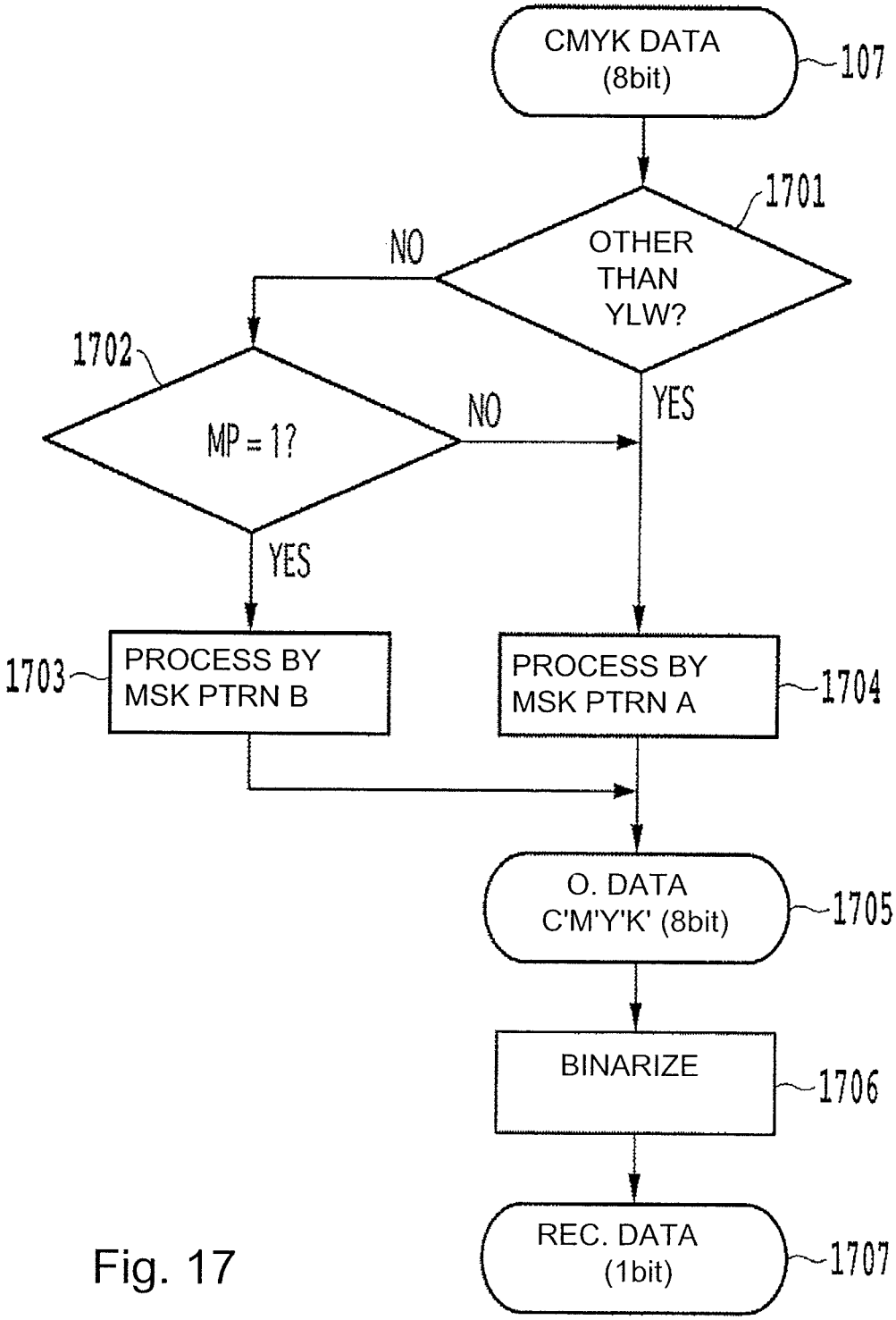
FIG. 17 is a flowchart for describing the image processing steps carried out by the system controller of the recording apparatus in the second embodiment.
Figure 18:
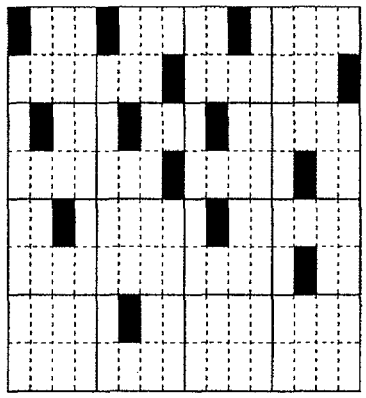
FIGS. 18(*a*)-18(*g*) are drawings for describing the image data, mask selection parameter MP, mask pattern, and example of recording data obtainable from the preceding variables.
Figure 21:
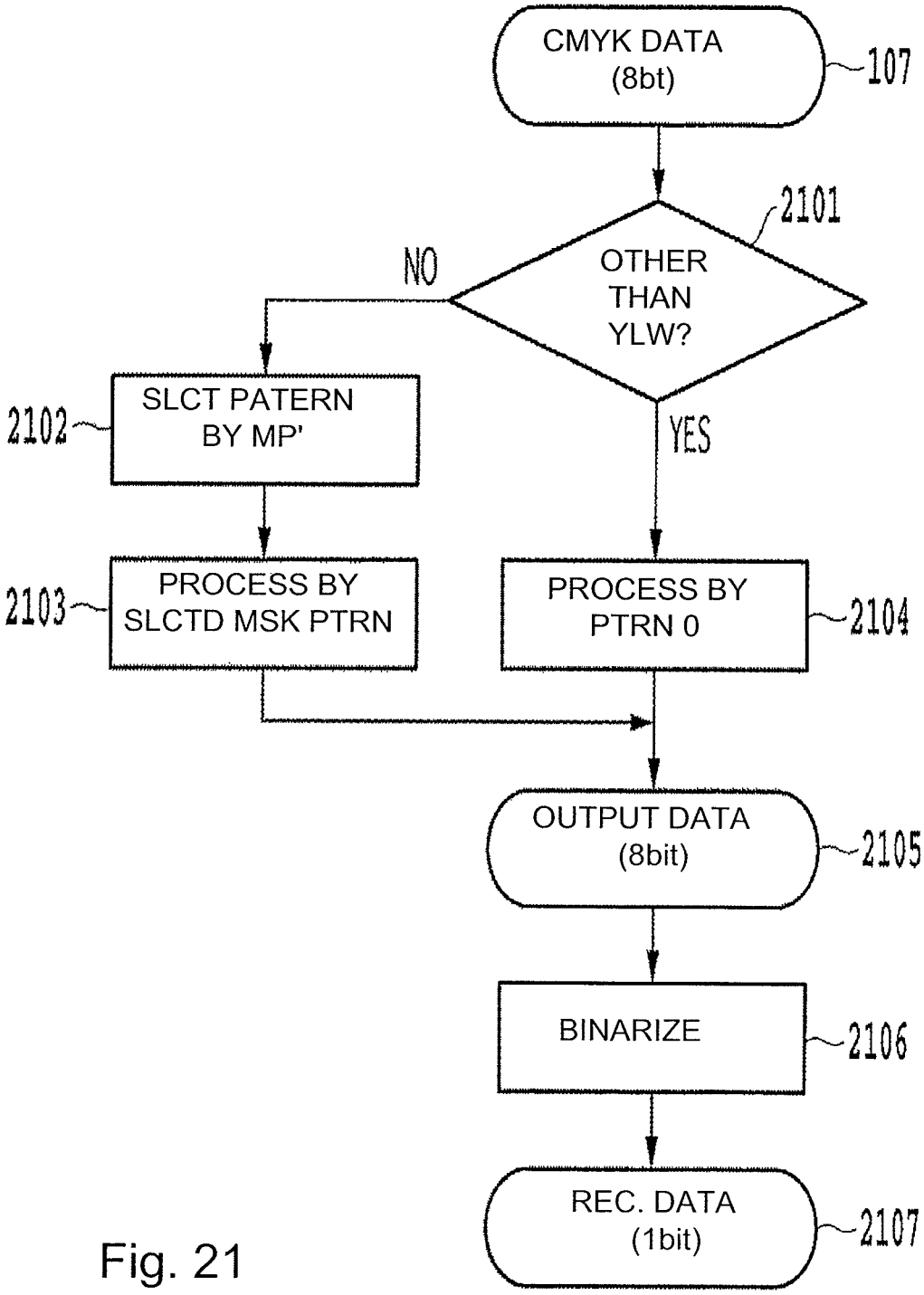
FIG. 21 is a flowchart for describing the image processing steps carried out by the system controller 301 of the recording apparatus in the third embodiment.
Figure 22:
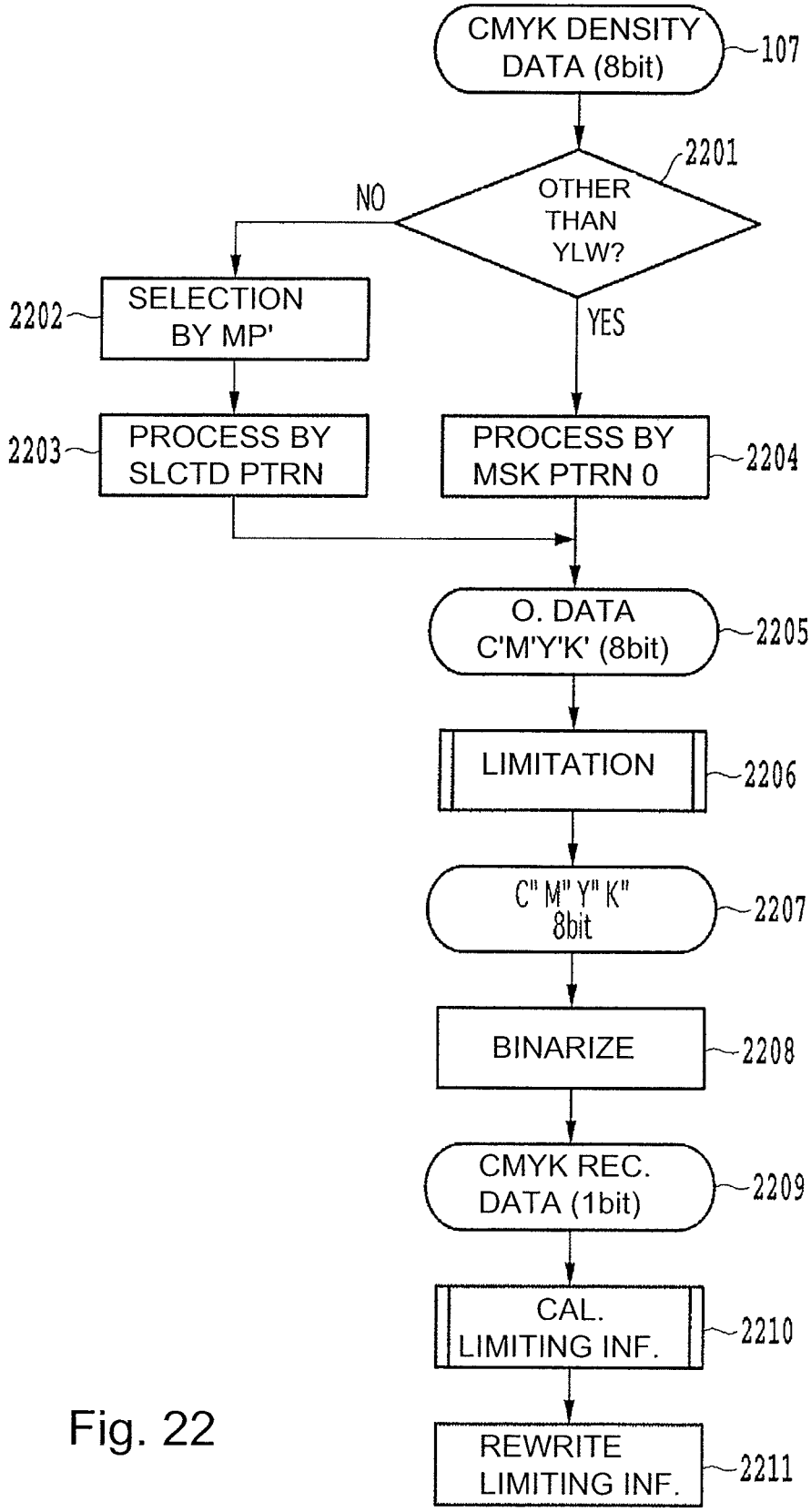
FIG. 22 is a flowchart for describing the image processing steps carried out by the system controller 301 of the recording apparatus in the fourth embodiment.
Figure 23:
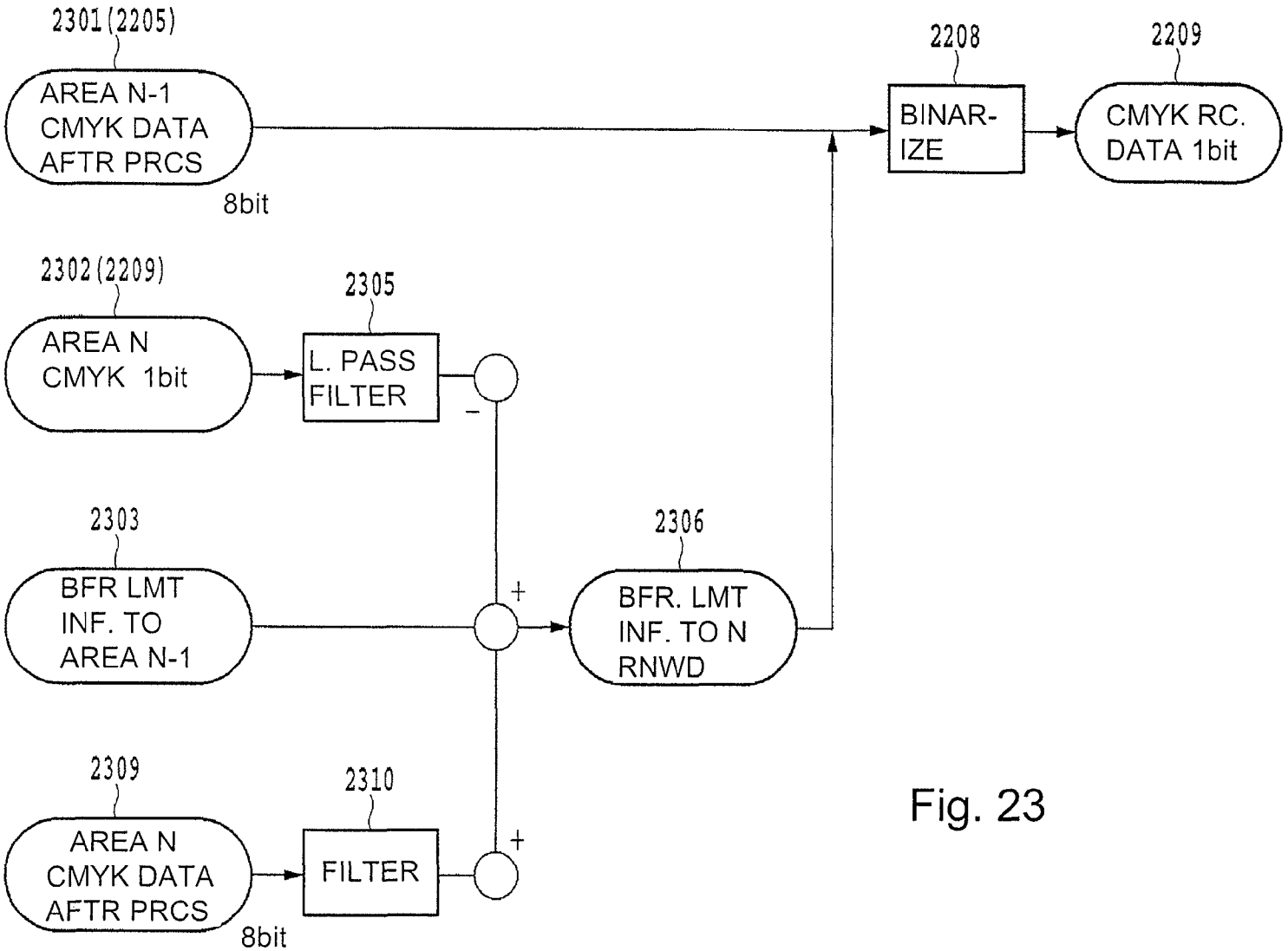
FIG. 23 is a schematic drawing for describing the computation and rewriting of the control information.
Figure 24:
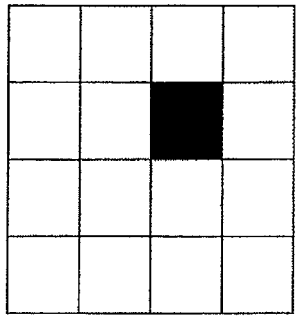
FIG. 24(*a*)-(i) are drawings for describing the image data, mask selection parameter, mask pattern, and the recording data obtainable from the preceding variables, in the fourth embodiment.
Figure 25:
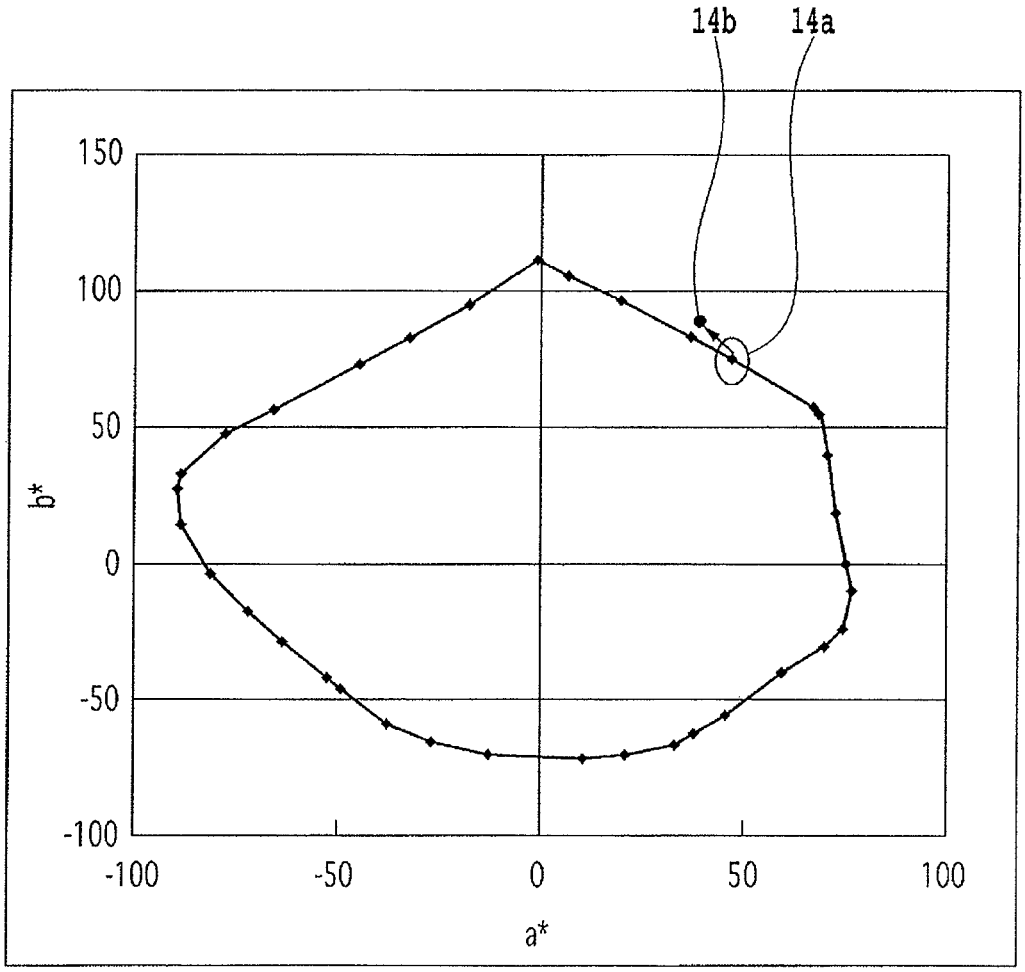
FIG. 25 is a chromaticity table for describing an example of the color range expansion.
Figure 26:
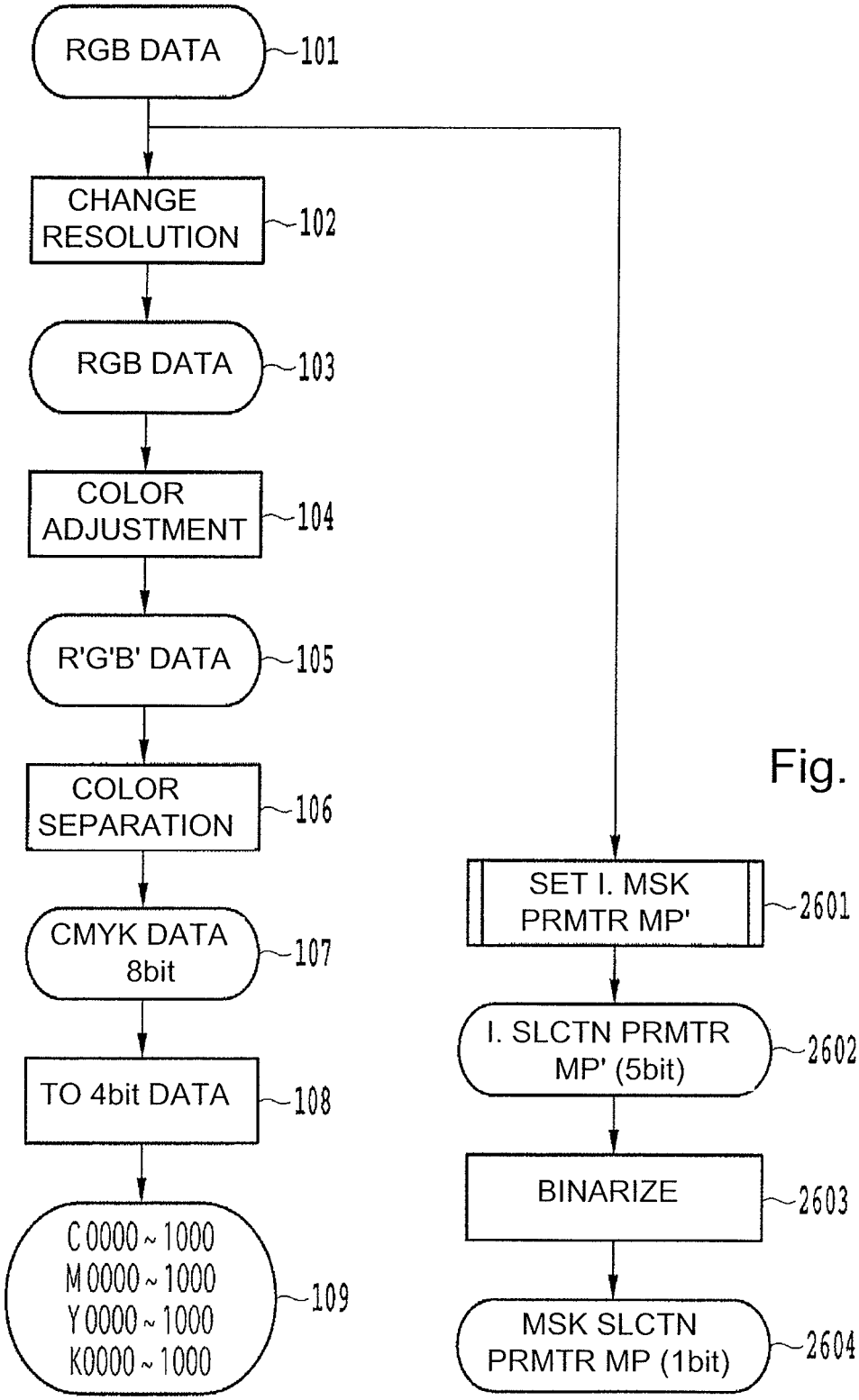
FIG. 26 is a flowchart for describing the image processing steps carried out by the host apparatus in the fifth embodiment.

| [Referential Symbols] | |
|---|---|
| 4Y: | yellow ink nozzle column |
| 4M: | magenta ink nozzle column |
| 4C: | cyan ink nozzle column |
| 4K: | black ink nozzle column |
| 11: | carriage |
| 12: | carriage motor |
| 13: | flexible cable |
| 14: | recovery means |
| 15: | sheet feeder tray |
| 16: | encoder |
| 17: | recording head |
| 141: | cap |
| 142: | ink catcher |
| 143: | ink catcher |
| 144: | wiper blade |

-continued

| [Referential Symbols] | |
|---|---|
| 301: | system controller |
| 302: | driver |
| 303: | driver |
| 305: | recording medium conveyance motor |
| 306: | host apparatus |
| 307: | reception buffer |
| 308: | frame memory |
| 309: | buffer |
| 310: | recording control portion |
| 311: | driver |

INDUSTRIAL APPLICABILITY

The present invention makes it possible to change, as necessary, the ratio with which recording is permitted for a specific ink, in any one of the multiple recording scans, based on the information regarding the specific ink applied to each unit pixel, and the information regarding the inks other than the specific ink. Therefore, it can change the recording scan to which the application of the specific ink is concentrate, making it possible to change the ratio with which the specific ink is applied before or after the other inks. Therefore, it can control the order in which the specific ink and the other inks are applied in layers.

What is claimed is:

1. An ink jet recording apparatus, comprising:

an ink applying unit configured to apply a plurality of inks including a first ink and a second ink, by a plurality of scans to a unit area of a recording material to record an image;

an obtaining unit configured to obtain information relating to an amount ratio of an amount of the first ink to be applied to the unit area by said ink applying unit to an amount of the second ink to be applied to the unit area by said ink applying unit;

a determining unit configured to determine a recording permission ratio of the first ink onto the unit area in each of the plurality of scans in accordance with the information obtained by said obtaining unit such that (i) the recording permission ratio of the first ink in a latter part of a scan, when the amount ratio is a first predetermined ratio, is higher than the recording permission ratio of the first ink in the latter part of the scan when the amount ratio is larger than the first predetermined ratio, or (ii) the recording permission ratio of the first ink in the final scan, when the amount ratio is a second predetermined ratio, is higher than the recording permission ratio of the first ink in the final scan when the amount ratio is larger than the second predetermined ratio; and a control unit configured to cause said ink applying unit to apply the first ink according to the recording permission ratio determined by said determining unit.

2. An ink jet recording apparatus according to claim 1, further comprising:

a storing unit configured to store a plurality of patterns for determining the recording permission ratio of the first ink onto the unit pixel for each scan, wherein said plurality of patterns includes patterns having different recording permission ratios of the first ink in at least one of the latter part of a scan and a final scan of the plurality of scans, and wherein said determining unit includes a selecting unit for selecting one of the plurality of patterns in accordance with the information, obtained by said obtaining unit, and the recording permission ratio is determined in accordance with the selection of the pattern by said selecting unit.

3. An ink jet recording apparatus according to claim 1, further comprising:

a storing unit configured to store a plurality of patterns for determining the recording permission ratio of the first ink onto the unit pixel for each scan, wherein said plurality of patterns includes patterns having different recording permission ratios of the first ink in at least one of an early part of a scan and an initial scan of the plurality of scans, and wherein said determining unit includes a selecting unit for selecting one of the plurality of patterns in accordance with the information, obtained by said obtaining unit, and the recording permission ratio is determined in accordance with the selection of the pattern by said selecting unit.

4. An ink jet recording apparatus according to claim 3, wherein said selecting unit selects a pattern having a relatively high recording permission ratio of the first ink in at least one of the early part of a scan and the initial scan when the ratio of the application amount of the first ink to the application amount of the second ink, determined on the basis of the information, obtained by said obtaining unit, is relatively low.

5. An ink jet recording apparatus according to claim 1, wherein the first ink is an ink of a first color, and the second ink is a second color, different from the first color.

6. An ink jet recording apparatus according to claim 1, wherein the first ink does not contain a colorant, and the second ink contains a colorant.

7. An ink jet recording apparatus according to claim 1, wherein the first ink has a wear resistance which is higher than that of the second ink.

8. An ink jet recording apparatus according to claim 1, wherein the information, obtained by said obtaining unit, is binary or multi-level information relating to the application amount of at least one of the first ink applied to the unit area and the second ink applied to the unit area.

9. An ink jet recording apparatus according to claim 1, wherein the information is RGB information relating to the first ink applied to the unit area and the second ink applied to the unit area.

10. An ink jet recording apparatus according to claim 1, wherein the first ink and the second ink have different colors.

11. An ink jet recording apparatus according to claim 1, wherein the first ink has a higher property of enhancement of friction resistance than the second ink.

12. An ink jet recording method for effecting recording onto a unit area of a recording material by a plurality of scans of an ink applying unit for applying a first ink and a second ink, the method comprising:

an obtaining step of obtaining information relating to an amount ratio of an amount of the first ink to be applied to the unit area by the ink applying unit to an amount of the second ink to be applied to the unit area by the ink applying unit;

a determining step of determining a recording permission ratio of the first ink onto the unit area in each of the plurality of scans in accordance with the information obtained in said obtaining step such that (i) the recording permission ratio of the first ink in a latter part of a scan, when the amount ratio is a first predetermined ratio, is higher than the recording permission ratio of the first ink in the latter part of a scan when the amount ratio is larger than the first predetermined ratio, or (ii) the recording permission ratio of the first ink in the final scan, when the amount ratio is a second predetermined ratio, is higher than the recording permission ratio of the first ink in a final scan when the amount ratio is larger than the second predetermined ratio; and a control step of causing the ink applying unit to apply the first ink according to the recording permission ratio determined in said determining step.

13. An ink jet recording method according to claim 12, wherein the first ink and the second ink have different colors.

14. An ink jet recording method according to claim 12, wherein the first ink has a higher property of enhancement of friction resistance than the second ink.

* * * * *